US011172754B2

(12) United States Patent
Hollis et al.

(10) Patent No.: US 11,172,754 B2
(45) Date of Patent: Nov. 16, 2021

(54) COLLAPSIBLE VESSEL

(71) Applicant: Design Fold LLC, Berkeley, CA (US)

(72) Inventors: John Rey Hollis, Berkeley, CA (US); Christine Ann Hollis, Berkeley, CA (US)

( * ) Notice: Subject to any disclaimer, the term of this patent is extended or adjusted under 35 U.S.C. 154(b) by 289 days.

(21) Appl. No.: 16/294,440

(22) Filed: Mar. 6, 2019

(65) Prior Publication Data

US 2020/0281343 A1 Sep. 10, 2020

(51) Int. Cl.

| | |
|---|---|
| ***A45F 3/20*** | (2006.01) |
| ***B65D 43/02*** | (2006.01) |
| ***B65D 21/08*** | (2006.01) |

(52) U.S. Cl.

CPC ..... *A45F 3/20* (2013.01); *B65D 21/086* (2013.01); *B65D 43/0212* (2013.01); *A45F 2003/205* (2013.01)

(58) Field of Classification Search

CPC ... A45F 3/20; A45F 2003/205; B65D 21/086; B65D 33/02; A47G 2019/2277; A47G 19/2205; A45C 11/22

USPC ..... 220/666, 676, 669, 737, 740, 738; 206/218

See application file for complete search history.

(56) References Cited

U.S. PATENT DOCUMENTS

| | | | |
|---|---|---|---|
| 1,025,380 | A | 5/1912 | Curtis et al. |
| 1,228,706 | A | 6/1917 | Smythe |
| 1,356,995 | A | 10/1920 | Mayer |
| 1,426,916 | A | 8/1922 | Schorpp |
| 1,530,256 | A | 3/1925 | Garland |
| 1,690,586 | A | 11/1928 | Main et al. |
| 2,234,065 | A | 3/1941 | Vogt |
| 2,382,573 | A | 8/1945 | Moore |
| 2,402,944 | A | 7/1946 | Braloff |

(Continued)

FOREIGN PATENT DOCUMENTS

CN 202457003 U 10/2012

OTHER PUBLICATIONS

Tim Johnson Design, Inc., Geocup, website address: http://www.geocup.com, Tim Johnson Design, Inc., Boston, MA, USA, Dec. 3, 2015.

(Continued)

*Primary Examiner* — Steven A. Reynolds

(74) *Attorney, Agent, or Firm* — Thomas P. O'Connell; O'Connell Law Firm

(57) ABSTRACT

A collapsible vessel reconfigurable between expanded and collapsed configurations. A sleeve combination has an inner sleeve rotatable relative to an outer sleeve. A liner is retained by the sleeve combination. The sleeves have opposed major walls divided by opposed fold line formations. Arrays of flexion apertures span a lateral range from adjacent to the respective fold line formation toward a central portion of the major wall, and an aperture density can vary generally based on distance from the fold line formation to promote a true-round confirmation of the expanded vessel. A lid structure with a disk and opposed retaining tabs can be selectively engaged with the liner, and a retaining strap can be pivotally coupled to the sleeve combination with a first orientation encircling the sleeve combination and a second, longitudinal orientation. A storage bag with first and second longitudinally-disposed stays can receive and further compress the vessel.

26 Claims, 14 Drawing Sheets

(56) References Cited

U.S. PATENT DOCUMENTS

| | | | |
|---|---|---|---|
| 2,853,222 | A | 9/1958 | Gallagher |
| 3,003,678 | A | 10/1961 | Chase |
| 3,136,475 | A | 6/1964 | Geimer |
| 3,184,149 | A | 5/1965 | Repko |
| 3,220,544 | A | 11/1965 | Lovell |
| 3,285,459 | A | 11/1966 | Gahin |
| 3,363,750 | A | 1/1968 | Smith |
| 3,372,859 | A | 3/1968 | Johansson |
| 3,373,917 | A | 3/1968 | Cox |
| 3,375,969 | A | 4/1968 | Davis |
| 3,437,258 | A | 4/1969 | Kugler |
| 3,521,807 | A | 7/1970 | Weisberg |
| 3,565,244 | A | 2/1971 | Wakefield |
| 3,604,491 | A | 9/1971 | Spiess |
| 3,640,381 | A | 2/1972 | Kanada et al. |
| 3,659,777 | A | 5/1972 | Kanada et al. |
| 3,684,156 | A | 8/1972 | Fettinger et al. |
| 3,684,157 | A | 8/1972 | Mendez et al. |
| 3,939,887 | A | 2/1976 | Scarnato |
| 4,196,034 | A | 4/1980 | Kimura |
| 4,257,535 | A | 3/1981 | Mellett |
| 4,284,205 | A | 8/1981 | Hirata |
| 4,391,366 | A | 7/1983 | Hirata |
| 4,408,644 | A | 10/1983 | Svantesson |
| 4,428,500 | A | 1/1984 | Kohler |
| 4,491,220 | A | 1/1985 | Daviss |
| 4,530,480 | A | 7/1985 | Pratt |
| 4,620,631 | A | 11/1986 | Bartelt |
| 4,792,086 | A | 12/1988 | Chen |
| 4,854,474 | A | 8/1989 | Murray et al. |
| 4,867,374 | A | 9/1989 | Murray et al. |
| 4,895,135 | A | 1/1990 | Hamasaki |
| 4,940,138 | A | 7/1990 | Hornstein |
| 4,941,754 | A | 7/1990 | Murdock |
| 5,101,996 | A | 4/1992 | Mosley |
| 5,132,124 | A | 7/1992 | Tamaki et al. |
| 5,188,261 | A | 2/1993 | Butters |
| 5,213,253 | A | 5/1993 | Fantoni et al. |
| 5,244,108 | A | 9/1993 | Hale |
| 5,255,808 | A | 10/1993 | Tobler |
| D345,673 | S | 4/1994 | Dark |
| 5,460,324 | A | 10/1995 | Vinther |
| 5,478,152 | A | 12/1995 | Bogle |
| 5,575,398 | A | 11/1996 | Robbins |
| 5,588,552 | A | 12/1996 | Johnson |
| D381,558 | S | 7/1997 | Schaeffer et al. |
| 5,842,634 | A | 12/1998 | Kieler |
| 6,126,010 | A | 10/2000 | Kogen |
| 6,227,439 | B1 | 5/2001 | Hansen |
| 6,260,756 | B1 | 7/2001 | Mochizuki et al. |
| 6,488,170 | B1 | 12/2002 | Johnson |
| 6,508,587 | B1 | 1/2003 | Byers |
| 6,527,169 | B2 | 3/2003 | Kim |
| 6,666,329 | B1 | 12/2003 | Charbonneau |
| 6,702,143 | B2 | 3/2004 | Wang |
| 6,736,285 | B2 | 5/2004 | Stewart-Stand |
| 7,128,934 | B1 | 10/2006 | Ohta et al. |
| 7,347,623 | B2 | 3/2008 | Cawley |
| D580,799 | S | 11/2008 | Curtin |
| 7,604,155 | B2 | 10/2009 | Bossel et al. |
| 7,757,881 | B1 | 7/2010 | Riley |
| 7,882,737 | B2 | 2/2011 | Coats et al. |
| 7,922,031 | B1 | 4/2011 | Prince |
| 8,333,296 | B1 | 12/2012 | Fung |
| 8,579,133 | B2 * | 11/2013 | Marcus ..... A47G 23/02 215/11.6 |
| 9,237,795 | B2 | 1/2016 | Hollis |
| 9,694,938 | B2 * | 7/2017 | Hollis ..... A47G 19/2205 |
| 2003/0160055 | A1 | 8/2003 | Stewart-Stand |
| 2005/0103834 | A1 | 5/2005 | Cousins |
| 2008/0035715 | A1 | 2/2008 | Abler |
| 2010/0019006 | A1 | 1/2010 | Van Art |
| 2010/0230407 | A1 | 9/2010 | Savage |
| 2013/0140305 | A1 * | 6/2013 | Hollis ..... B65D 33/02 220/4.28 |
| 2014/0103036 | A1 | 4/2014 | Perlman |
| 2016/0159518 | A1 | 6/2016 | Hollis et al. |

OTHER PUBLICATIONS

Collapse A Cup, Collapse A Cup, website address: http://www.collapse-a-cup.com, Collapse A Cup, Hamden, CT, USA, Dec. 3, 2015.

Nada Bottle, LLC., Nada Bottle, website address: https://www.nadabottle.com, Crested Butte, CO, USA, Dec. 3, 2015.

Niki Singlaub, Hydaway Bottle, website address: http://hydawaybottle.com/ Bend, Oregon, USA, Dec. 3, 2015.

Humangear, Inc., GoCup, website address: http://www.humangear.com/gocup/, San Francisco, CA, USA, Dec. 3, 2015.

Karla Zens, Zip Cup: Revolutionary Collapsible Coffee Cup, website address: http://www.zipcup.com, Dec. 3, 2015.

Ben Melinger, Stojo The Collapsible Pocket Cup, website address: http://www.stojo.co, Brooklyn, NY, USA, Dec. 3, 2015.

* cited by examiner

COLLAPSIBLE VESSEL

FIELD OF THE INVENTION

The present invention relates generally to collapsible vessels. Stated more particularly, disclosed herein is a collapsible vessel, such as a beverage cup, that can be selectively converted from an expanded, use configuration to a collapsed, flattened configuration by a rotation of an outer sleeve in relation to an inner sleeve.

BACKGROUND OF THE INVENTION

The need for vessels, such as cups, that are convenient and effective in use and reuse and that can be stored and transported conveniently has been well recognized. Typical disposable cups are normally limited to a single use after which they are discarded, which is wasteful and not environmentally friendly. Glass, ceramic, and other non-disposable vessels can be cleaned and used repeatedly, but they are usually not practical to store and transport during travel. Prior art beverage cups and other vessels are thus demonstrably limited in their portability, availability, and convenience.

A number of skilled inventors have proposed vessel structures, including beverage cups, with a collapsed configuration for storage and transport and an expanded configuration for usage. With U.S. Pat. No. 8,333,296, Duncan Fung disclosed a thermally insulated foldable cup. Unfortunately, the cup of the '296 patent requires assembly and has plural components that can be difficult to clean and that can be inadvertently dislodged. Similarly, other prior art collapsible vessels present a risk of unintended collapsing, which can lead not only to a loss of the retained beverage or other material but also mess, inconvenience, and potential physical harm from hot beverages and other hazards.

Furthermore, many collapsible cups remain bulky even when in a collapsed configuration. Additionally, collapsible cups of the prior art can be challenging to clean and dry and difficult to adjust between collapsed and use configurations. Collapsible cups that are hard to clean and dry lead to poor hygienic results, foul tastes, and potential leakage during storage. Further still, collapsible cups of the prior art are rarely elegant in appearance and do not approximate the appearance of a traditional cup.

Collapsible cups taught by the prior art have sought to address one or more of the foregoing issues but have struggled to remedy these several challenges simultaneously. Widespread usage and commercial success of collapsible vessels have resultantly been limited.

Recognizing the need for a collapsible structure capable of overcoming the foregoing disadvantages, certain of the inventors herein proposed a collapsible vessel in what is now U.S. Pat. No. 9,694,938. The collapsible vessel of the '938 patent sought to be quickly and conveniently reconfigurable from a collapsed configuration for storage and transport to an expanded, use configuration. The disclosed vessel is durable and is readily employed for hot and cold beverages.

The collapsible cup of U.S. Pat. No. 9,694,938 represented a useful advance in the art. However, the present inventors have discovered that further advances in the art of collapsible vessels are possible and worthwhile. For instance, it would be advantageous to render manufacturing and material usage still more efficient. A vessel that is stably retained in a generally cylindrical configuration during use while also being capable of achieving an optimally flattened configuration during storage would be still more advantageous. Moreover, a storage mechanism that not only promotes secure and convenient storage but that also tends to achieve further compression of the vessel and residual moisture evacuation would further enhance the collapsible vessel system.

SUMMARY OF THE INVENTION

The invention is thus founded on the basic object of providing a collapsible vessel that can achieve a stable and effective use configuration and that can be quickly and conveniently reconfigured to a collapsed configuration in which the vessel can be retained for storage and transport.

A further object of the invention is to provide a collapsible vessel that realizes improvements in manufacturing and material efficiencies while remaining effective and durable in usage.

Still another object of embodiments of the invention is to provide a collapsible vessel that resists inadvertent collapsing.

A related object of embodiments of the invention is to provide a collapsible vessel that is capable of receiving and retaining a lid structure against over-insertion and displacement.

A further object of the invention is to provide a collapsible vessel that can be readily gripped and manipulated between use and collapsed configurations.

Another object of the invention is to provide a collapsible vessel that can be retained in a compact and easily stowed configuration to resist leakage and contamination between uses.

Yet another object of embodiments of the invention is to provide a collapsible vessel that can be readily disassembled and cleaned.

Embodiments of the invention have the additional object of providing a collapsible vessel that is durable and easy to use and that can retain both hot and cold beverages.

A further object of embodiments of the invention is to provide a collapsible vessel that approximates the appearance and feel of a traditional vessel while permitting the performance characteristics of a collapsible and expandable construction.

These and further objects and advantages of embodiments of the invention will become obvious not only to one who reviews the present specification but also to one who has an opportunity to make use of an embodiment of the collapsible vessel disclosed herein. It will be appreciated, however, that, although the accomplishment of each of the foregoing objects in a single embodiment of the invention may be possible and indeed preferred, not all embodiments will seek or need to accomplish each and every potential object and advantage. Nonetheless, all such embodiments should be considered within the scope of the invention.

In carrying forth one or more objects of the invention, a collapsible vessel as disclosed herein is reconfigurable between an expanded configuration with an open inner volume for retaining a volume of material and a collapsed configuration. The collapsible vessel has a sleeve combination comprising an inner sleeve and an outer sleeve. The sleeve combination has a top, a bottom, and a longitudinal direction. The inner sleeve has first and second opposed major walls divided by opposed fold line formations, and the outer sleeve has first and second opposed major walls divided by opposed fold line formations. Each fold line formation comprises at least one longitudinal fold line, which in a non-limiting example can comprise a living hinge. A liner of flexible material is provided for being retained by the inner and outer sleeves wherein the liner is formed of flexible material.

The inner sleeve and the outer sleeve are relatively rotatable so that the vessel can be retained in the expanded configuration with an open inner volume and a mouth defined by the liner when the opposed fold line formations of the inner sleeve are not aligned with the opposed fold line formations of the outer sleeve and the vessel can be reconfigured to the collapsed configuration when the opposed fold line formations of the inner sleeve and the outer sleeve are aligned.

Arrays of flexion apertures are disposed in the opposed major walls of at least one of the inner sleeve and the outer sleeve. As disclosed herein, the arrays of flexion apertures can be disposed and configured to facilitate a substantially true-round shape of the vessel when the vessel is in an expanded configuration. Flexion aperture arrays could be configured to cause the collapsible vessel to achieve or approximate other shapes. Embodiments disclosed herein provide flexion arrays of array densities and configurations that promote a truly round, cylindrical configuration of the vessel when in an expanded configuration.

In embodiments of the collapsible vessel, arrays of flexion apertures can be disposed in the opposed major walls of both the inner sleeve and the outer sleeve. Those arrays of flexion apertures in the opposed major walls of the inner sleeve and the outer sleeve can at least partially match in aperture shape and position. In particular practices of the invention, at least one aperture in the outer sleeve aligns with at least one aperture in the inner sleeve when the collapsible vessel is in the collapsed configuration. It is further disclosed that the array of flexion apertures in each major wall can be symmetrically disposed in the major wall, and the array of flexion apertures in each major wall can span a lateral range from adjacent to the respective fold line formation toward a central portion of the major wall. The central portion of each major wall of the sleeve in which an array of flexion apertures is disposed can be substantially solid.

It is disclosed that each array of flexion apertures can have an aperture density that varies generally based on distance from the fold line formation adjacent to the array of flexion apertures. For instance, the aperture density can increase from adjacent to the central portion of each major wall to adjacent to the fold line formation.

Manifestations of the collapsible vessel can include a lid structure for selectively being engaged with the mouth defined by the liner when the collapsible vessel is in the expanded configuration. The lid structure is founded on a disk and at least one retaining tab that projects from the disk. The retaining tab has a proximal end retained by the disk and a distal end with a protuberance that is disposed to face outwardly from the retaining tab when the tab is in an upward position extending longitudinally within the vessel and the disk is disposed in a plane lateral to the vessel.

The liner can be considered to define a rim with an upper edge when the collapsible vessel is in the expanded configuration, the at least one retaining tab can be considered to have a length from the proximal end of the at least one retaining tab to a proximal surface of the protuberance of the distal end of the at least one retaining tab, and the disk can be considered to have a thickness in proximity to the at least one retaining tab. An annular retaining formation can be disposed on the liner for engaging the disk of the lid structure with the retaining formation spaced from the upper edge of the rim defined by the liner by approximately the length of the retaining tab from the proximal end of the at least one retaining tab to a proximal surface of the protuberance of the distal end of the at least one retaining tab. With that, the at least one retaining tab can cooperate with the retaining formation on the liner to prevent over-insertion of the disk of the lid structure.

Embodiments are disclosed wherein a retaining strap is retained by the sleeve combination. The retaining strap has a first orientation wherein the strap encircles the sleeve combination in a direction generally lateral to the longitudinal direction and a second orientation wherein the strap is disposed generally along the longitudinal direction to span over the top and the bottom of the sleeve combination. The strap can, for instance, be pivotally retained by the sleeve combination at first and second pivoting locations so that there are first and second strap sections between the pivoting locations. Still further, to facilitate manipulation of the strap and gripping of the collapsible vessel in general, a gripping nub can be disposed along each strap section.

It is further contemplated that the invention can include a storage bag for retaining the sleeve combination and the liner when the collapsible vessel is in the collapsed configuration. The storage bag has a main body of flexible material with first and second walls, a closed bottom, and a mouth, and at least one stay of substantially rigid, resiliently deflectable material retained by the main body of the storage bag. The at least one stay can, for example, be V-shaped with a bottom and first and second legs, the at least one stay retained by the main body of the storage bag with the bottom of the at least one stay disposed to span the closed bottom of the main body of the storage bag and the legs of the at least one stay aligned with a longitudinal of the storage bag from the closed bottom to the mouth of the storage bag. The legs of the at least one stay can be arcuate over their lengths, and it is further taught that there can be first and second stays retained generally in parallel. The stays can operate to progressively compress the collapsible vessel as the vessel is inserted into the storage bag and, potentially, the legs of the stays are pressed toward one another.

According to manifestations of the invention, the inner and outer sleeves can be considered to have lower ends and upper ends, and the upper end of the inner sleeve can extend beyond the upper end of the outer sleeve by a given distance such that an upper portion of the inner sleeve forms a rim portion of the sleeve combination. The liner can have a body portion comprising a sidewall and a bottom that together form a liquid-tight container with a mouth and an inner volume when the collapsible vessel is in the expanded configuration, and the rim portion can be disposed in a position overlapping the body portion of the liner to encircle the rim portion of the sleeve combination. In particular embodiments, the rim portion of the liner has a height approximately equal to the distance by which the inner sleeve extends beyond the outer sleeve of the sleeve combination.

Still further, it is taught that each fold line formation can comprise a group of at least two fold lines. With that, there are at least two fold lines to a first side of each sleeve and at least two fold lines to a second side of each sleeve opposite the first side whereby the sleeves have opposed minor walls.

One will appreciate that the foregoing discussion broadly outlines the more important features of the invention merely to enable a better understanding of the detailed description that follows and to instill a better appreciation of the inventors' contribution to the art. Before an embodiment of the invention is explained in detail, it must be made clear that the following details and descriptions of inventive concepts are mere examples of the many possible manifestations of the invention.

DETAILED DESCRIPTION OF PREFERRED EMBODIMENTS

Figure 1:
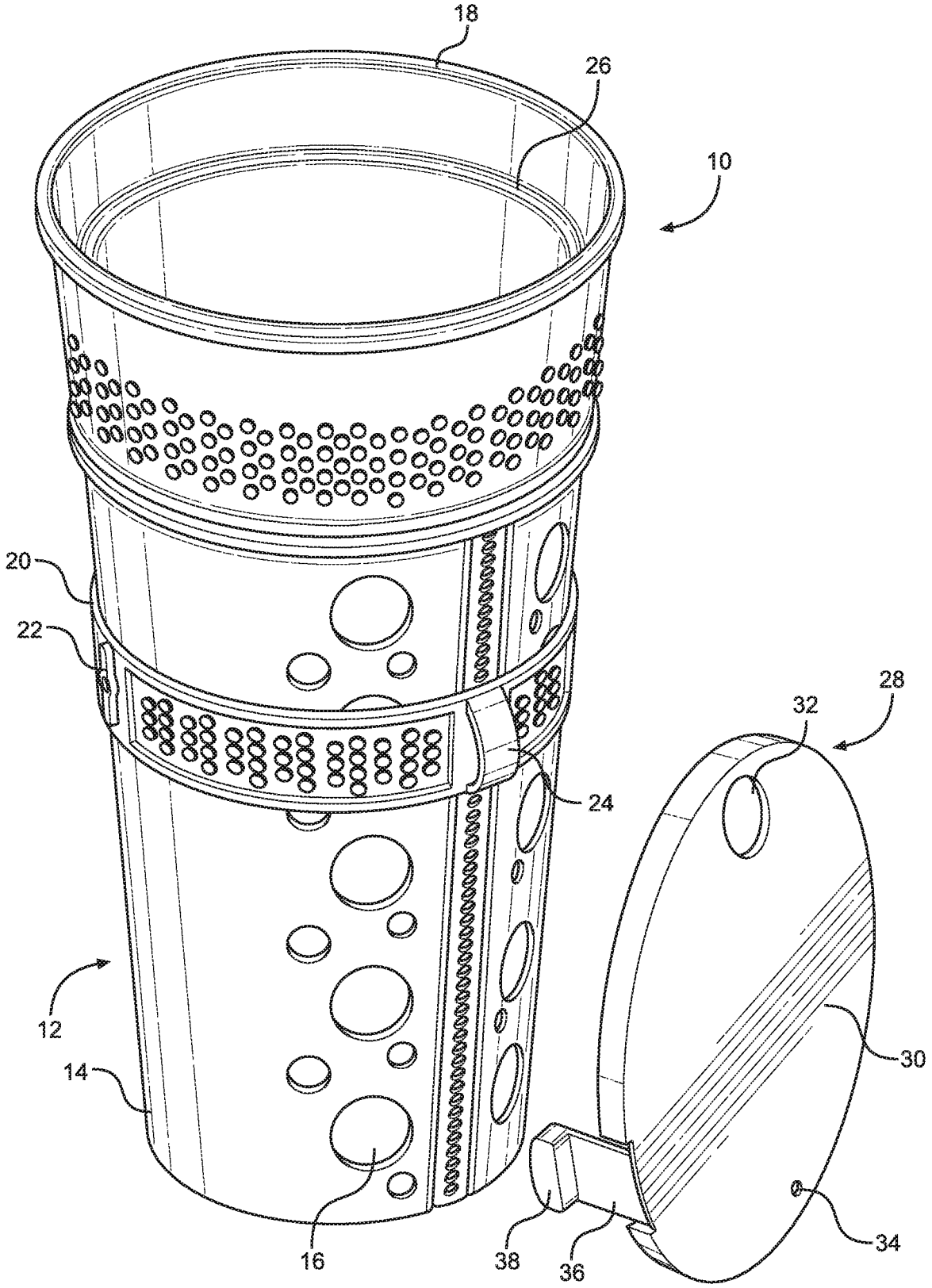
FIG. 1 is a perspective view of a collapsible vessel as taught herein in an expanded, use configuration and with the vessel lid.

The collapsible vessel disclosed herein is subject to varied embodiments, each within the scope of the invention. However, to ensure that one skilled in the art will be able to understand and, in appropriate cases, practice the present invention, certain preferred embodiments of the broader invention revealed herein are described below.

Turning more particularly to the drawings, a collapsible vessel according to the present invention is indicated generally at 10 in FIGS. 1 through 12. The collapsible vessel 10 shown in the drawings may have particular application as a cup. However, it will be understood that that other types of vessels are included within the scope of the claims except as they may be expressly limited. The collapsible vessel 10 is reconfigurable between an expanded or use configuration as shown in FIGS. 1 through 6 and a collapsed configuration as shown in FIGS. 9 through 12.

The collapsible vessel 10 is founded on a sleeve combination 12 that matingly receives a flexible liner 18. The sleeve combination 12 is formed by an outer sleeve 14 and an inner sleeve 16 that is received within the outer sleeve 14. As is described further hereinbelow, the outer sleeve 14 is rotatable in relation to the inner sleeve 16. When the collapsible vessel 10 is in the expanded configuration, the sleeve combination 12 pursues an annular, generally cylindrical configuration. In the expanded configuration, the outer and inner sleeves 14 and 16 are concentrically disposed, and the liner 18 pursues a tubular configuration with a closed bottom and an open mouth. When the vessel 10 is to be reconfigured to the collapsed configuration, the lid structure 28 is removed, and the inner and outer sleeves 16 and 14 are relatively pivoted to permit the sleeves 14 and 16 and the liner 18 pursue a flattened relationship. As is also described further hereinbelow, when the collapsible vessel 10 is in the expanded configuration, a lid structure 28 can be selectively disposed to occupy the open mouth of the liner 18 thereby to enclose an inner volume bounded by the liner 18 and the lid structure 28.

The flexible liner 18 lines the sleeve combination 12. More particularly, the liner 18 in this example lines the inner sleeve 16. Accordingly, when the collapsible vessel 10 of this embodiment is in the expanded configuration, the outer and inner sleeves 14 and 16 have corresponding, expanded shapes, such as concentric cylindrical shapes, and an open inner volume is defined by the liner 18 within the vessel 10. Where the vessel 10 is configured as a cup by way of a non-limiting example, the inner volume can be used to retain a beverage or other comestible. When the collapsible vessel 10 is in the collapsed configuration, the liner 18 and the inner volume defined thereby are likewise flattened.

It will be understood that the sleeves 14 and 16 need not be cylindrical in shape when in the expanded configuration. Other expanded shapes are possible. Furthermore, as used herein, reference to a cylindrical or a generally cylindrical configuration shall not require a precisely annular shape and shall include, without limitation, frusto-conical shapes, shapes with consistent cylinders, and other shapes that comprise or include generally cylindrical portions. Furthermore, reference to a flattened configuration shall not require that the sleeves 14 and 16 or the liner 18 actually be flat or have a flat configuration or portion. Flattened should be understood only to indicate that that the sleeves 14 and 16 and the liner 18 are flatter than when in the expanded configuration.

The sleeve combination 12 and each of the inner and outer sleeves 16 and 14 thereof has an open upper end and an open lower end. The inner and outer sleeves 16 and 14 can be made of the same or different materials. In certain embodiments, for instance, the inner and outer sleeves 16 and 14 could be crafted from a polymeric material. For instance, the inner and outer sleeves 16 and 14 could be formed from a thermoplastic polymer, such as polypropylene (pp), or any other material capable of being reconfigured between expanded and collapsed configurations as disclosed herein.

As can be appreciated by combined reference to FIGS. 8 and 12 through 14, for example, the lower end of the inner sleeve 16 in this embodiment terminates approximately equally with the lower end of the outer sleeve 14 when the sleeves 14 and 16 are fully engaged. However, the inner sleeve 16 has an upper portion that extends beyond the upper end of the outer sleeve 14 by a given distance such that the upper portion of the inner sleeve 16 forms a rim portion of the sleeve combination 12.

Figure 13:
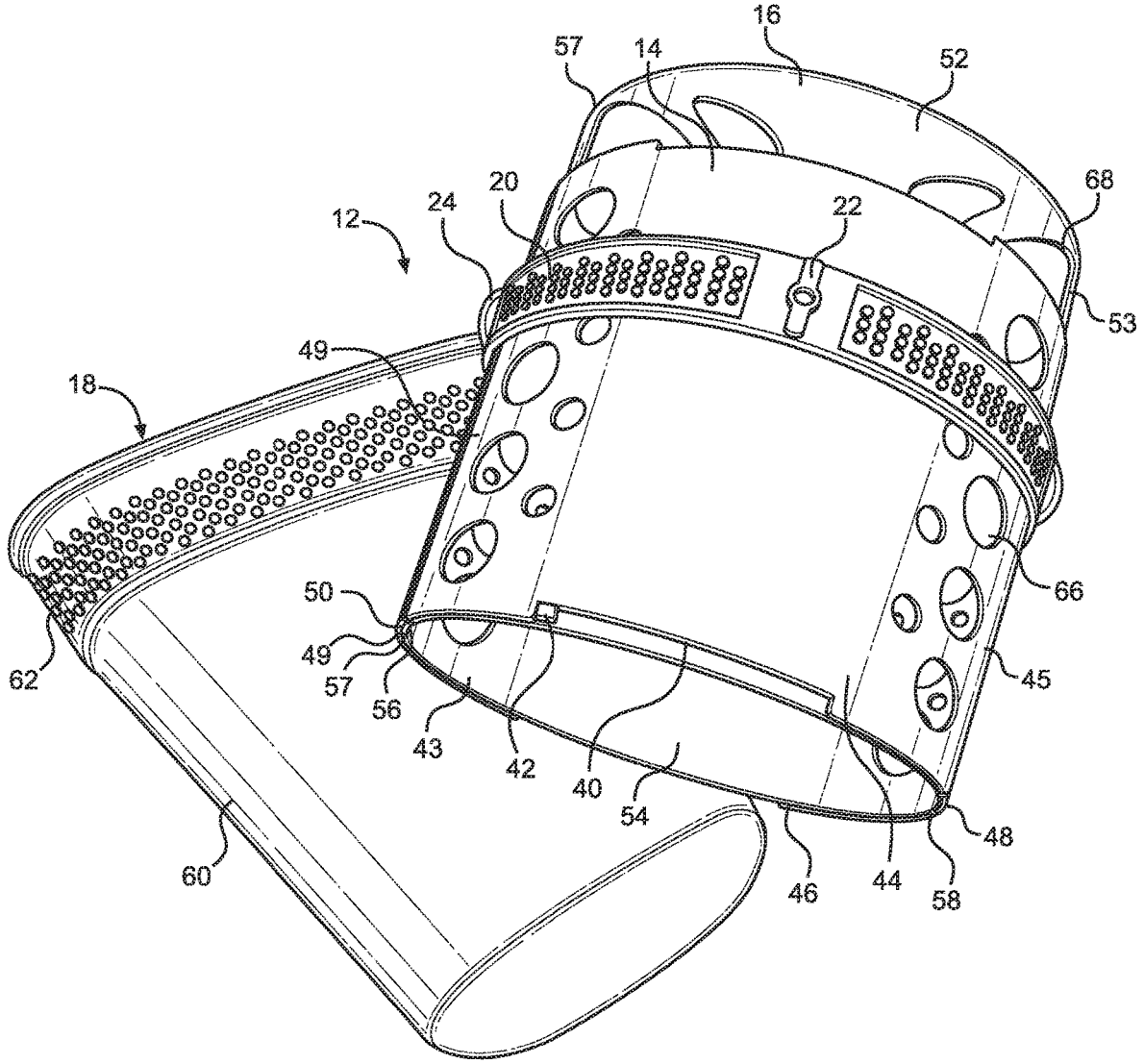
FIG. 13 is a perspective view of the collapsible vessel in a partially disassembled configuration.

As shown in FIG. 13, for instance, the flexible liner 18 has a body portion 60 with a generally tubular sidewall and a bottom that together form a liquid-tight container with an open top and an inner volume when the collapsible vessel 10 is in the expanded configuration. A rim portion 62 of the liner 18 is coupled to the body portion 60 along an annular fold line. In the depicted embodiment, the body and rim portions 60 and 62 are integrally formed, such as by molding or otherwise. The rim portion 62 can be disposed in a downward position to encircle and overlap an upper section of the body portion 60 thereby to form an overlying rim. The rim portion 62 of the liner has a height approximately equal to the distance by which the upper portion of the inner sleeve 16 extends beyond the upper end of the outer sleeve 14. The body portion 60 of the liner 18 has a height somewhat less than the height of the inner sleeve 16.

Under this construction, when the liner 18 is inserted into the sleeve combination 12, the rim portion 62 can be caused to overlie the upper portion of the inner sleeve 16 that extends beyond the upper end of the outer sleeve 14, and the body portion 60 of the liner 18 can extend longitudinally within the inner sleeve 16 to terminate marginally short of the lower ends of the inner and outer sleeves 16 and 14 and the sleeve combination 12 in general. When desired, such as to facilitate removal and cleaning of the liner 18, the liner 18 can be slipped off and out of the inner sleeve 16. To facilitate such removal and, additionally or alternatively, cleaning, the rim portion 62 of the liner 18 can be flipped upwardly about the annular fold line as necessary to extend generally collinearly with the body portion 60.

The liner 18 is formed from a flexible, liquid-tight material. By way of a non-limiting example, the liner 18 could be formed from a flexible thermoplastic polymer. Alternatively, the liner 18 could be formed from a rubber, such as a food grade silicone, or from any other flexible material. The liner 18 can be readily slipped from the sleeve combination formed by the inner and outer sleeves 16 and 14, such as for cleaning.

The reconfigurable nature of the sleeve combination 12 and of the collapsible vessel 10 in general is facilitated in this example of the invention by a formation of each of the inner and outer sleeves 16 and 14 from a resiliently flexible material, such as a plastic, and from forming each sleeve 14 and 16 with at least two longitudinal fold line formations. In this example, the outer sleeve 14 is divided into first and second opposed major walls 44 and 46 by first and second longitudinally-disposed fold line formations 45 and 49 therebetween disposed in 180-degree opposition. The fold line formations 45 and 49 permit a relative hinged pivoting of the opposed major walls 44 and 46 of the outer sleeve 14 relative to one another. Similarly, the inner sleeve 16 is divided into first and second opposed major walls 52 and 54 by first and second longitudinally-disposed fold line formations 53 and 57 therebetween disposed in 180-degree opposition. The fold line formations 53 and 57 permit a relative hinged pivoting of the opposed major walls 52 and 54 of the inner sleeve 16 relative to one another. The resiliency of the sleeves 14 and 16 and the pivoting permitted by the fold line formations 45, 49, 53, and 57 permit the sleeves 14 and 16 to be reconfigured between expanded configurations and collapsed configurations.

Each fold line formation 45, 49, 53, and 57 is formed by at least one fold line longitudinally disposed in the respective sleeve 14 or 16. In the depicted embodiment, each fold line formation 45, 49, 53, and 57 is formed by two closely spaced fold lines. With that, the first and second opposed major walls 44 and 46 of the outer sleeve 14 have minor walls 48 and 50 interposed therebetween. The minor walls 48 and 50 are disposed to opposite sides of the sleeve 14 in general opposition. Likewise, the first and second opposed major walls 52 and 54 of the inner sleeve 16 have minor walls 56 and 58 interposed therebetween. The minor walls 56 and 58 are disposed to opposite sides of the sleeve 16 in general opposition. The fold lines within each fold line formation 45, 49, 53, and 57 are substantially parallel. The fold lines in this embodiment comprise living hinges integrally formed in the structures of the sleeves 14 and 16.

Within the scope of the invention except as it may be expressly limited by the claims, more than two fold lines could be provided in each fold line formation 45, 49, 53, and 57, or it would be possible for each fold line formation 45, 49, 53, and 57 to have a single fold line. Fold line formations 45, 49, 53, and 57 within a given embodiment could have different numbers of fold lines. Where three fold lines are provided in each group, the outer sleeve 14 could, for instance, be divided into first and second opposed major walls 44 and 46 with a first group of two minor walls 48 disposed in opposition to a second group of two minor walls 40. Similarly, the inner sleeve 16 could have first and second major walls 52 and 54 disposed in opposition and separated by first and second groups of two minor walls 56 and 58 to each side thereof.

By virtue of the relative pivotability of the inner and outer sleeves 16 and 14, the resilience of the material forming the sleeves 14 and 16, and the collapsibility permitted by the fold line formations 45, 49, 53, and 57, the collapsible vessel 10 can be quickly and conveniently reconfigured between the expanded, use configuration and the collapsed configuration. When the collapsible vessel 10 is in a use configuration, the fold line formations 45, 49, 53, and 57 of the inner and outer sleeves 16 and 14 are disposed out of alignment, such as by being spaced approximately ninety degrees apart. With that, the collapsible vessel 10 is locked in a substantially round, use configuration with an open inner volume established within the liner 18 for retaining a beverage, comestible material, or any other substance. The major walls 44, 46, 52, and 54 operate to brace the fold line formations 45, 49, 53, and 57 against folding when the fold line formations 45, 49, 53, and 57 are out of alignment. The inner and outer sleeves 16 and 14 can be rotated, such as over a ninety degree interval, to bring the fold line formations 45, 49, 53, and 57 into alignment as seen, for instance, in FIGS. 8, 11, and 12. With the fold lines 45, 49, 53, and 57 aligned, the collapsible vessel 10 can be reconfigured to a collapsed configuration, such as for transport and storage.

In the present inventors' U.S. Pat. No. 9,694,938, it was disclosed that it could be advantageous to have a collapsible cup with sleeves having walls that taper toward the edges thereof to facilitate a round formation of the cup when in an expanded configuration and a flat disposing of the cup when in a collapsed configuration. However, such a varying thickness introduces complexities in the formation of the sleeves and does not necessarily provide savings in material usage.

It has now been conceived of by the present inventors that a roundness of the vessel 10 when in a use configuration and, potentially, a flattening of the vessel 10 to a collapsed configuration and savings in materials can be concomitantly achieved by forming predetermined arrays of flexion apertures 66 and 68 in the major walls 44, 46, 52, and 54 of the sleeves 14 and 16. More particularly, as shown for instance in FIGS. 13 and 14, a first flexion aperture array 66 is disposed in the outer sleeve 14 and a second flexion aperture array 68 is disposed in the inner sleeve 16. The aperture arrays 66 and 68 facilitate bowing of the walls 44, 46, 52, and 54 and the sleeves 14 and 16 ideally to a true-round configuration, and the aperture arrays 66 and 68 facilitate flattening of the walls 44, 46, 52, and 54 in the collapsed configuration. The arrays 66 and 68 of flexion apertures herein are disposed and configured to facilitate a substantially true-round shape of the vessel 10 when the vessel 10 is in an expanded configuration. Within the scope of the invention, flexion aperture arrays 66 and 68 could be configured to cause the collapsible vessel 10 to achieve or approximate other shapes. Here, the flexion arrays 66 and 68 of array have densities and configurations that promote a truly round, cylindrical configuration of the vessel 10 when in an expanded configuration.

In each sleeve 14 and 16, the respective aperture arrays 66 and 68 are symmetrically disposed in the walls 44, 46, 52, and 54 with portions spanning a given lateral range from adjacent to the respective fold line formations 45, 49, 53, and 57 toward a central portion of the walls 44, 46, 52, and 54 and a given longitudinal range from adjacent to the lower end of the respective sleeve 14 or 16 to adjacent to the upper end of the respective sleeve 14 or 16. A central portion of each wall 44, 46, 52, and 54 is substantially solid, and the density of the apertures of the arrays 66 and 68 increases from adjacent to the central portions of the walls 44, 46, 52, and 54 to adjacent to the fold line formations 45, 49, 53, and 57. Aperture density may be considered to be the average open area defined by the apertures. Stated alternatively, as the aperture arrays 66 and 68 approach the respective fold line formations 45, 49, 53, and 57, the absence of material exhibited by the arrays 66 and 68 tends to increase on average with the proviso that it may not increase linearly and that solid portions may necessarily be included, such as immediately adjacent to the fold line formations 45, 49, 53, and 57. As a result, the resistance of the walls 44, 46, 52, and 54 to deflection can be controlled, such as by causing the walls 44, 46, 52 and 54 to exhibit reduced resistance to deflection generally in proportion to the proximity to the fold line formations 45, 49, 53, and 57. The tendency of the sleeve combination 12 to achieve a substantially round configuration when expanded can thus be controlled and, in this embodiment, increased.

Figure 10:
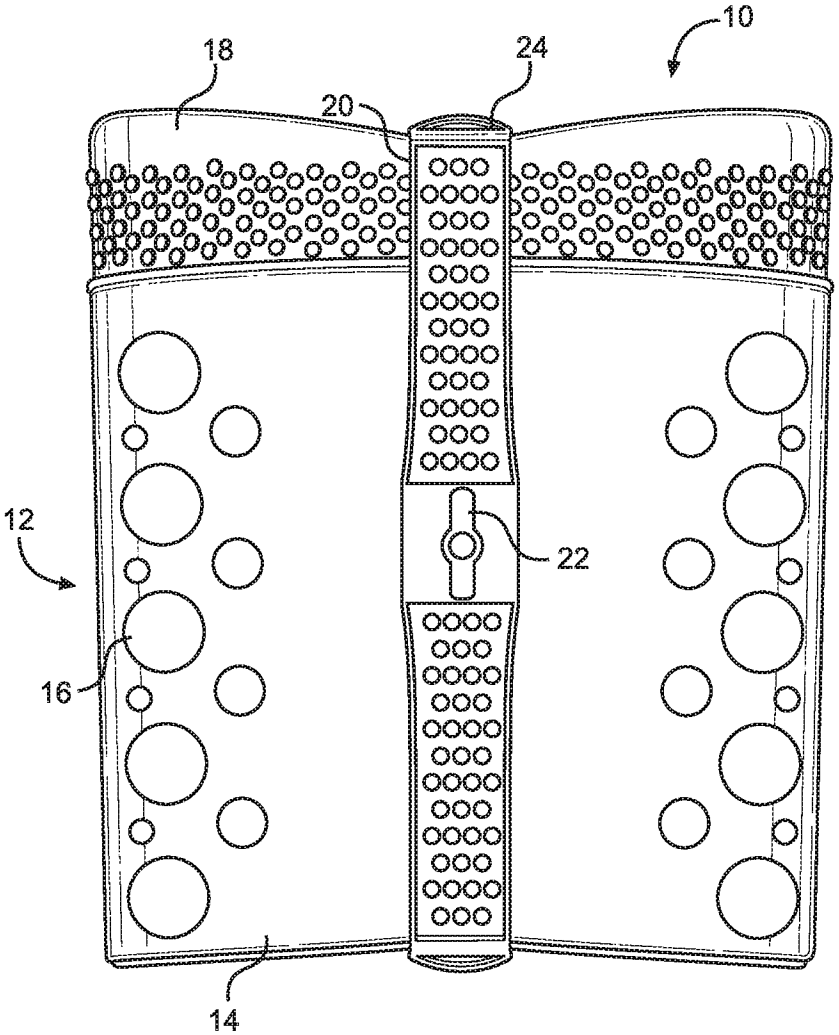
FIG. 10 is a perspective view of the collapsible vessel secured in a collapsed configuration.
Figure 9:
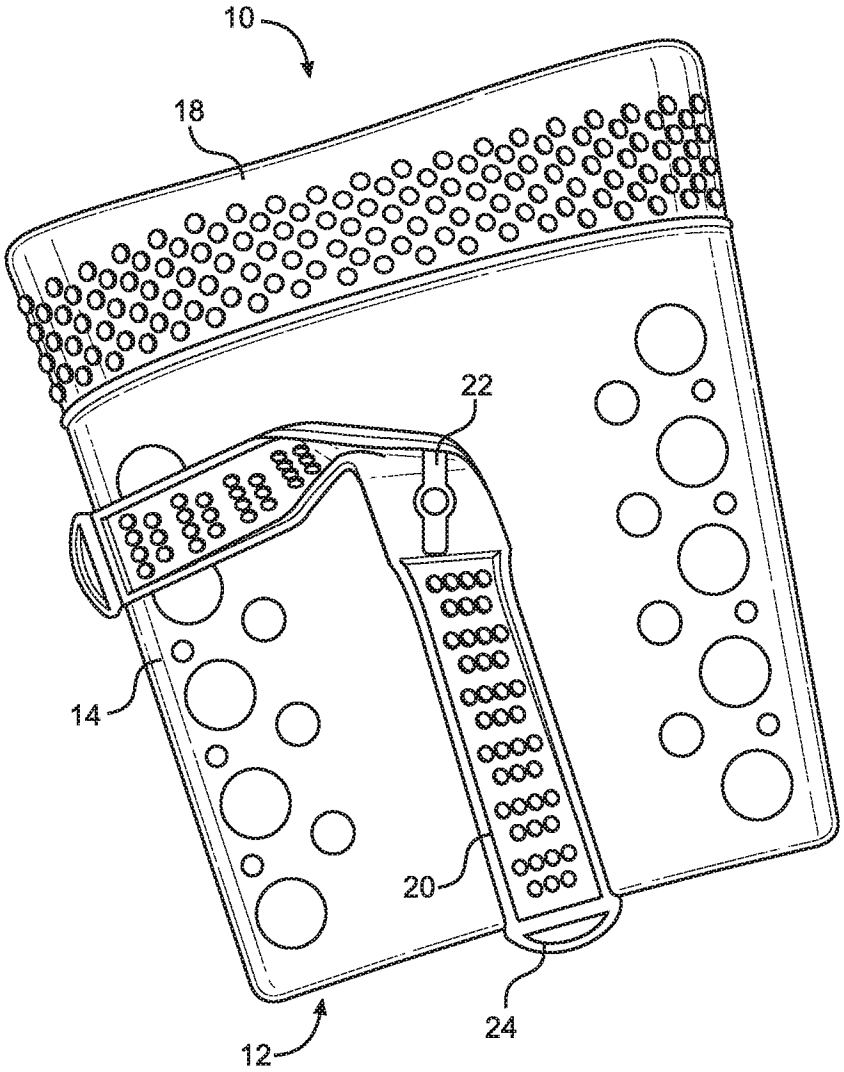
FIG. 9 is a perspective view of the collapsible vessel in the process of being secured in a collapsed configuration.

In this embodiment, in the overlapping portions of the aperture arrays 66 and 68, some or all of the arrays 66 and 68 can be matching in the number, configuration, shape, and position of apertures forming the array 66 and 68. With that, the inner and outer sleeves 16 and 14 can be caused to tend to exhibit predetermined deflection characteristics based on the flexion facilitated by the array 66 and 68. A substantially round condition of the vessel 10 when in an expended configuration can be promoted, and a flattened collapsed condition of the vessel 10 can be facilitated. Meanwhile, the manufacturing complications deriving from walls with tapering thicknesses are eliminated, and material savings are achieved, including by the elimination of needed materials in the apertures of the aperture arrays 66 and 68. Moreover, when the inner and outer sleeves 16 and 14 are in alignment, as in the collapsed configuration, the apertures of the overlapping portions of the aperture arrays 66 and 68 will align to give visual confirmation of the aligned nature of the sleeves 16 and 14, and the apertures of the arrays 66 and 68 will be out of alignment when the vessel 10 is in the expanded configuration, again giving visual confirmation of the fully expanded configuration. Gripping of the vessel 10 by use of the apertures of the arrays is improved, and unique design appearances can be achieved, including by permitting visualization of the body portion 60 of the liner 18 when in a collapsed configuration and a visualization of the inner sleeve 16 when in an expanded configuration. Still further, as shown in FIGS. 9 and 10, when the sleeves 14 and 16 are aligned in the collapsed configuration, the lowermost apertures of the arrays 66 and 68 tend to be aligned and clear of the liner 18 such that through-holes are provided at the lower corners of the flattened vessel 10, which can permit convenient storage, retention, or carrying of the vessel 10, such as through a hook, clip, carabiner, or other mechanism.

Figure 14:
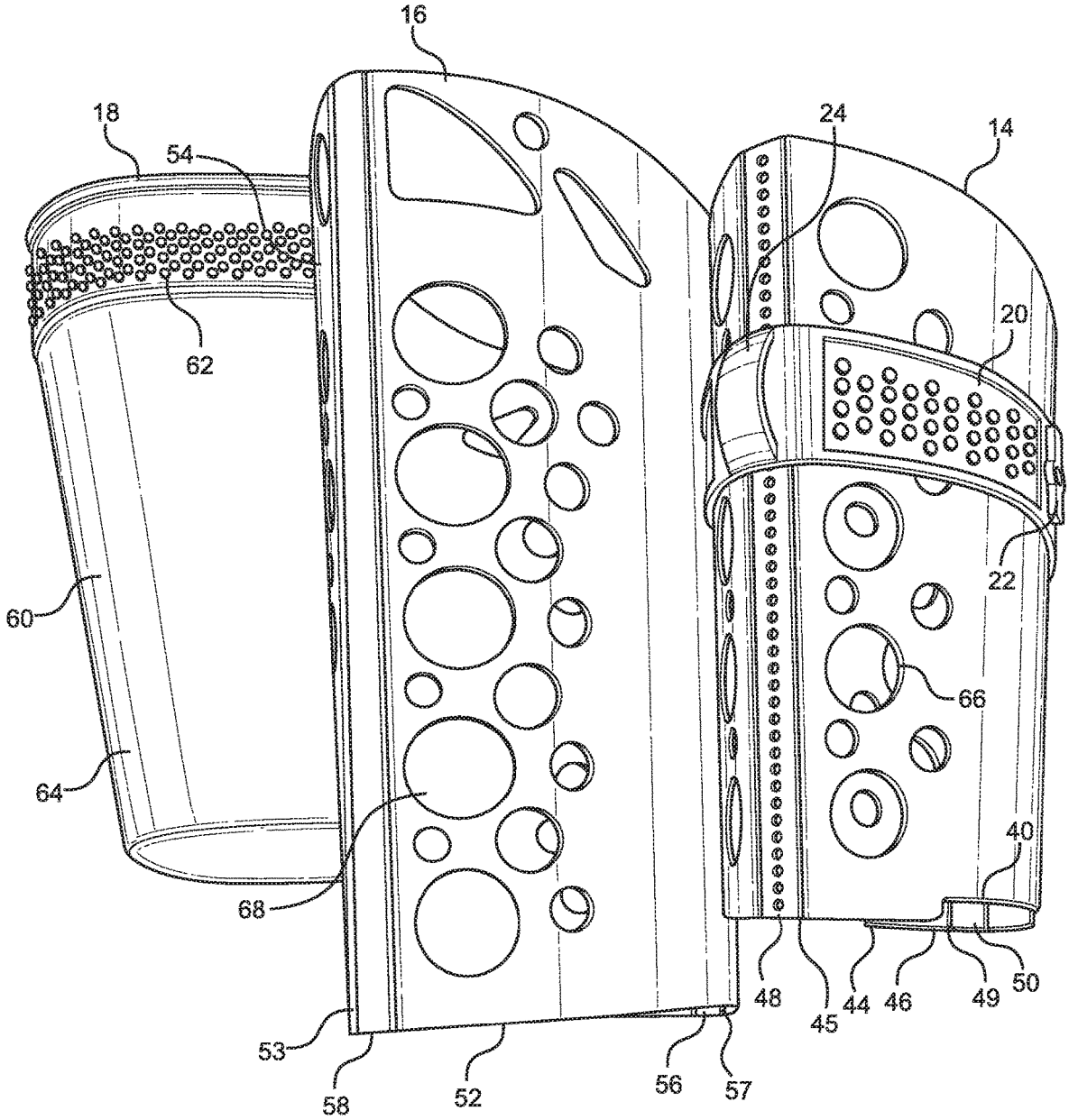
FIG. 14 is a perspective view of the collapsible vessel in a further disassembled configuration.

In this example of the vessel 10 as is best shown perhaps in FIG. 14, the apertures of the aperture array 66 of the outer sleeve 14 has a first series of round apertures of a first size disposed in longitudinal alignment adjacent to each fold line formation 45 and 49 and a second series of round apertures of a second size smaller than the first size disposed in longitudinal alignment further spaced from each fold line formation 45 and 49 and staggered with the apertures of the first series. Further, a third series of apertures smaller of a third size smaller than the first and second sizes is disposed in longitudinal alignment staggered between the first series of apertures and the fold line formations 45 and 49.

Again looking to FIG. 14, for instance, the apertures of the aperture array 68 of the inner sleeve 16 has a first series of round apertures of a first size disposed in longitudinal alignment adjacent to each fold line formation 53 and 57 and a second series of round apertures of a second size smaller than the first size disposed in longitudinal alignment further spaced from each fold line formation 53 and 57 and staggered with the apertures of the first series. Further, a third series of apertures smaller of a third size smaller than the first and second sizes is disposed in longitudinal alignment still further spaced from each fold line formation 53 and 57 and staggered in relation to the second series of apertures. Still further, a fourth series of apertures smaller of a fourth size, which can be smaller than the first and second sizes, is disposed in longitudinal alignment staggered between the first series of apertures and the fold line formations 53 and 57. In the portions of the walls 52 and 54 extending beyond the outer sleeve 14, the aperture array 68 of the inner sleeve 16 further includes contoured, generally triangular shaped apertures with broadened aperture openings adjacent to the respective fold line formation 53 and 57 and tapered portions extending therefrom.

Figure 5:
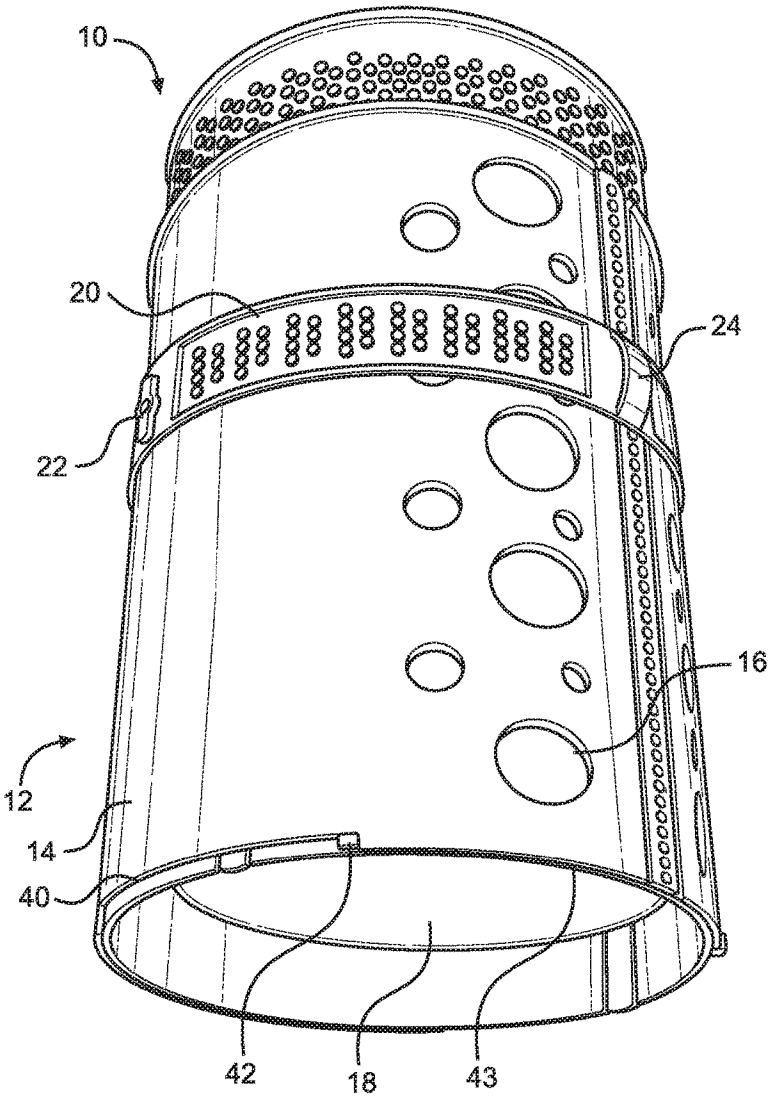
FIG. 5 is a lower perspective view of the collapsible vessel.
Figure 8:
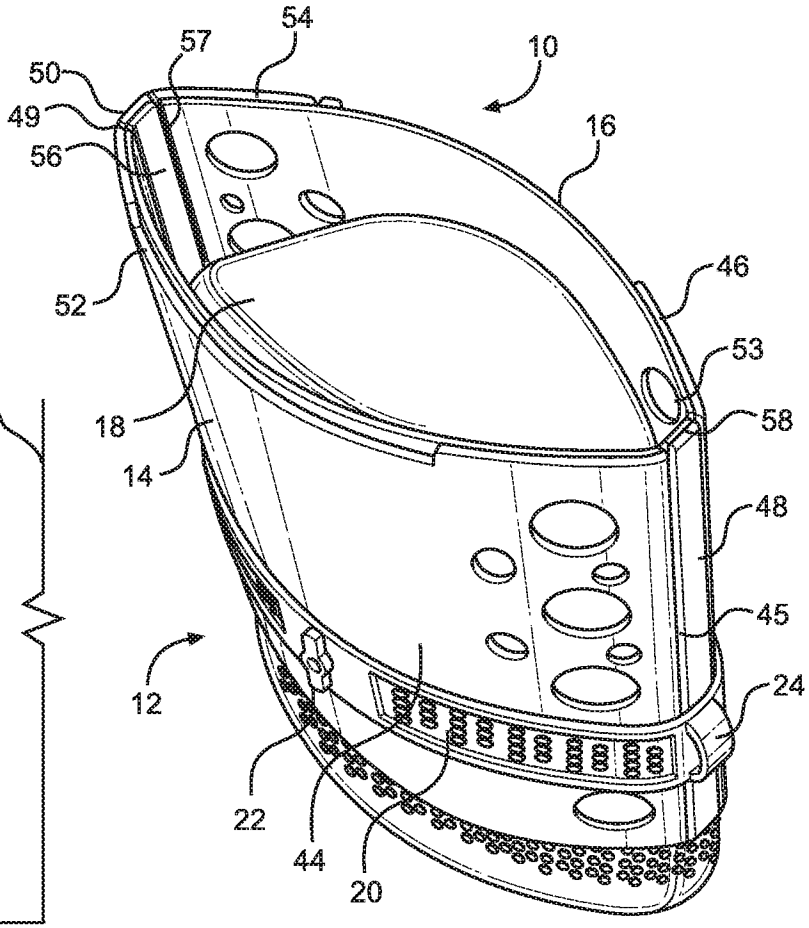
FIG. 8 is a lower perspective view of the collapsible vessel in a partially collapsed configuration.
Figure 7:
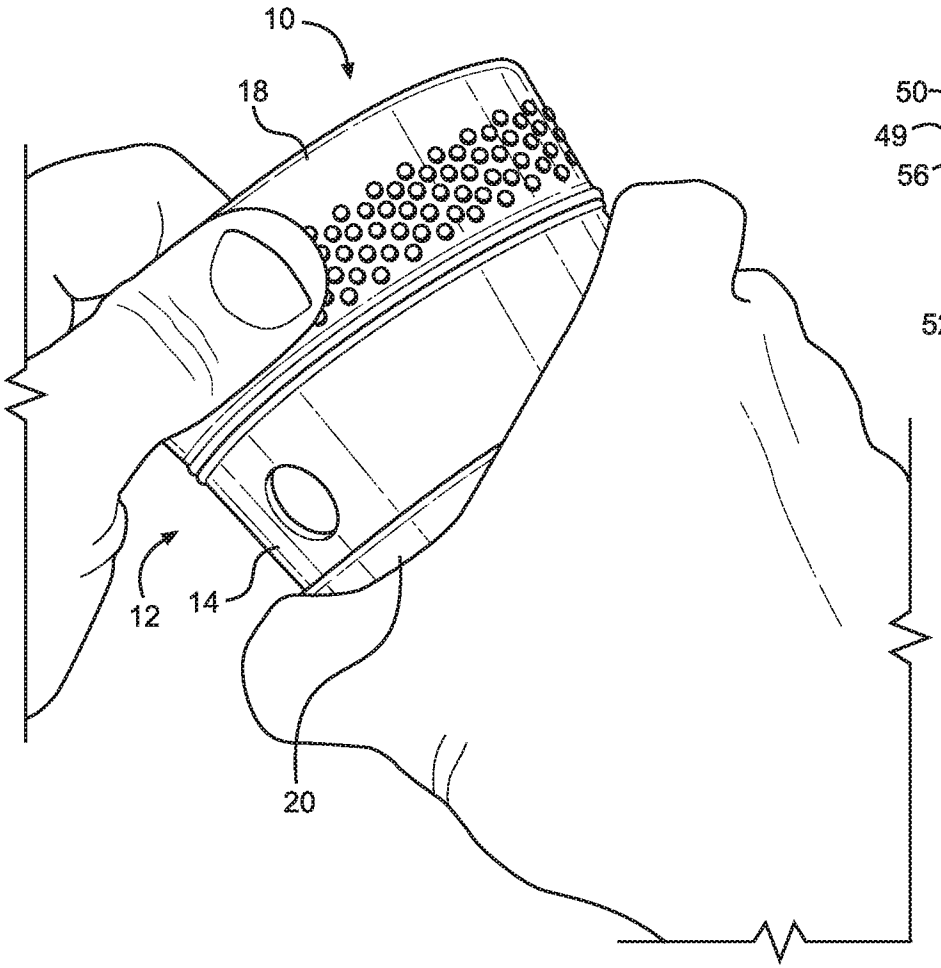
FIG. 7 is a perspective view of the collapsible vessel in the process of being collapsed.

The inner and outer sleeves 16 and 14 forming the sleeve combination 12 incorporate a rotation limiting structure to prevent over-rotation of the outer sleeve 14 relative to the inner sleeve 16. As best seen in FIGS. 5 and 13, for instance, the inner sleeve 16 has one or more retaining protuberances 42 that project radially outward therefrom. In the depicted embodiment, there are first and second retaining protuberances 42 that project from bottom portions of the major walls 52 and 54 to each side of the inner sleeve 16. The outer sleeve 14 has a longitudinal extension portion 43 that extends from the lower portion thereof. A delimited channel is formed in the outer sleeve 14 between the ends of the longitudinal extension portion 44. With that, the inner and outer sleeves 16 and 14 can be rotated in relation to one another over a given angular rotation, such as over a ninety degree interval, from a first relative orientation where a protuberance 42 contacts a first end of the longitudinal extension portion 43 at a first end of the delimited channel to a second relative orientation where a protuberance 42 contacts a second end of the longitudinal extension portion 43 at a second end of the delimited channel.

It will be understood that the protuberance or protuberances 42 and the delimited channel or channels could be oppositely disposed or differently configured within the scope of the invention. Without limitation, the delimited channel could be disposed spaced from the lower ends of the inner and outer sleeves 16 and 14, such as in the form of a slot in the outer or inner sleeve 14 or 16. In other embodiments, for example, the delimited channel, which again comprises a rotation limiting formation, can be formed as a slot or slots in one of the sleeves 14 or 16, such as the inner sleeve 16, that guides the relative rotation of the sleeves 14 and 16 and limits movement of the inner sleeve 16 relative to the outer sleeve 14. A protuberance or protuberances could be provided on the other sleeve 14 or 16. Such a slot can limit relative rotation to approximately ninety degrees while retaining the sleeves 14 and 16 so that the outer sleeve 14 does not inadvertently dislodge from the inner sleeve 18.

Looking again to FIGS. 1 and 2, the lid structure 28 can be selectively engaged with the sleeve combination 12 and the liner 18 when the collapsible vessel 10 is in the expanded configuration to close the open end or mouth of the liner 18 and to cooperate to bound a substantially enclosed inner volume within the collapsible vessel 10. As shown, for instance, in FIG. 1 and with additional reference to FIG. 13, the liner 18 has a retaining formation 26, more specifically a protuberating ridge 26 in this embodiment, that encircles the inner surface of the liner 18 spaced proximally from the fold line that forms the upper edge of the liner 18 and the collapsible vessel 10 when the rim portion 62 is folded over to overlie and encircle the body portion 60 of the liner 18. The ridge 26 is disposed within a plane perpendicular to a longitudinal axis of the liner 18 and the collapsible vessel 10 in general. Within the scope of the invention, the retaining formation 26 could alternatively be a furrow, more than one ridge, or some other formation that encircles the inner surface of the liner 18 adjacent to the mouth thereof.

The lid structure 28 is founded on a disk 30 of substantially rigid material that has a peripheral shape that corresponds to the shape of the mouth defined by the liner 18 when in an expanded configuration. In this non-limiting example, the mouth of the liner 18 and the disk 30 are round. The disk 30 is sized to have an interference fit within the mouth of the liner 18, such as by having a diameter marginally greater than a relaxed diameter of the mouth of the liner 18. The protuberating ridge 26 establishes a reduced dimension within the liner 18, such as a reduced diameter and circumference. The reduced dimension is smaller than the corresponding dimension, such as the diameter and circumference, of the disk 30.

Under this relationship and in view of the resilient flexibility of the material of the liner 18 and the substantial rigidity of the material of the disk 30, the lid 28 can be inserted into the open mouth of the liner 18 until reaching the protuberating ridge 26. With the disk 30 in contact with the ridge 26 and with the surrounding body portion 62 of the liner 18, a liquid-tight seal is created between the lid 28 and the flexible liner 18. The ridge 26 prevents over-insertion of the disk 30 of the lid structure 28 and induces the disk 30 to be in a plane parallel to the upper edge of the sleeve combination 12 and perpendicular to the longitudinal axis of the collapsible vessel 10.

Figure 2:
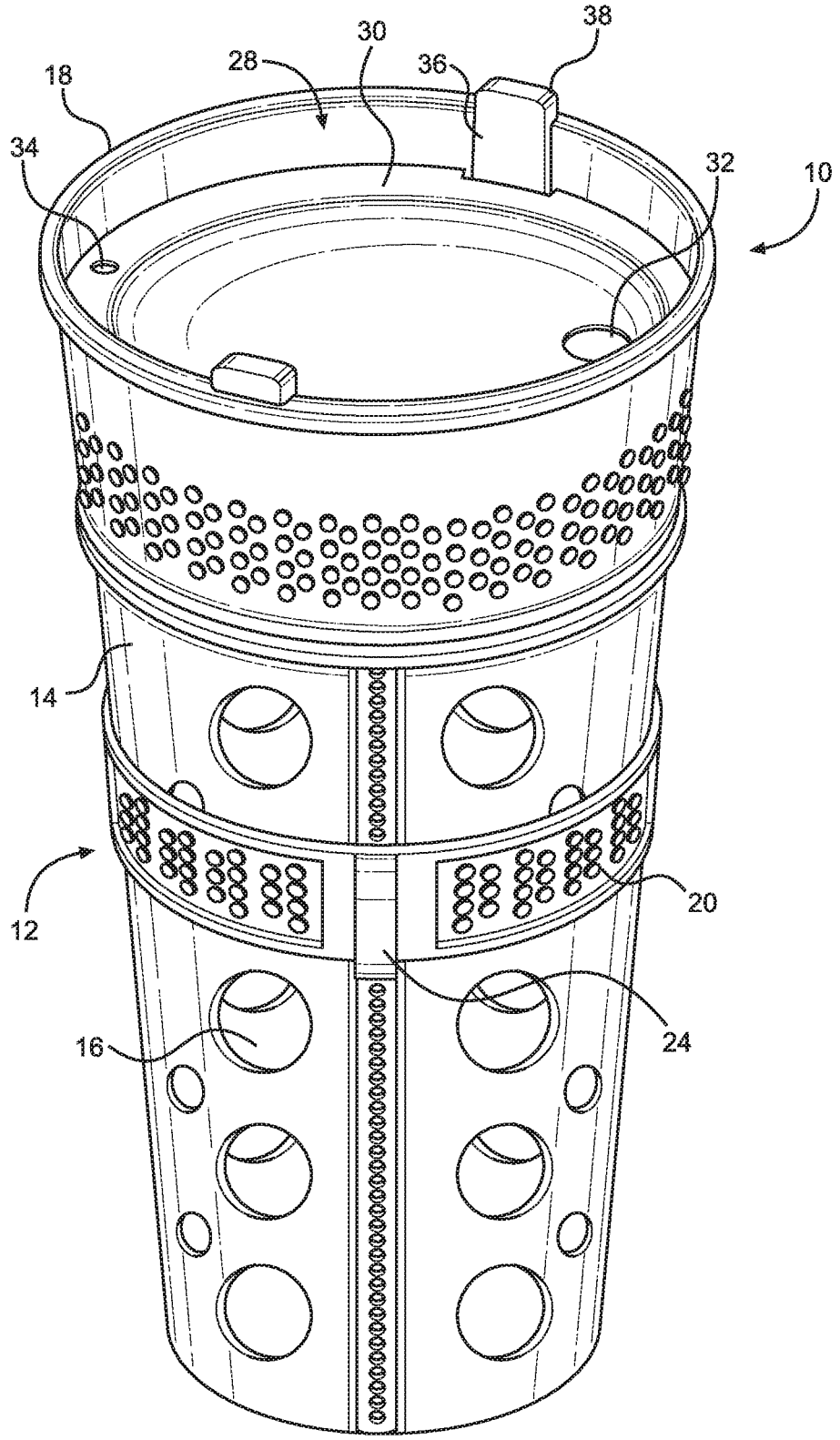
FIG. 2 is a perspective view of the collapsible vessel with the vessel lid in place.
Figure 4:
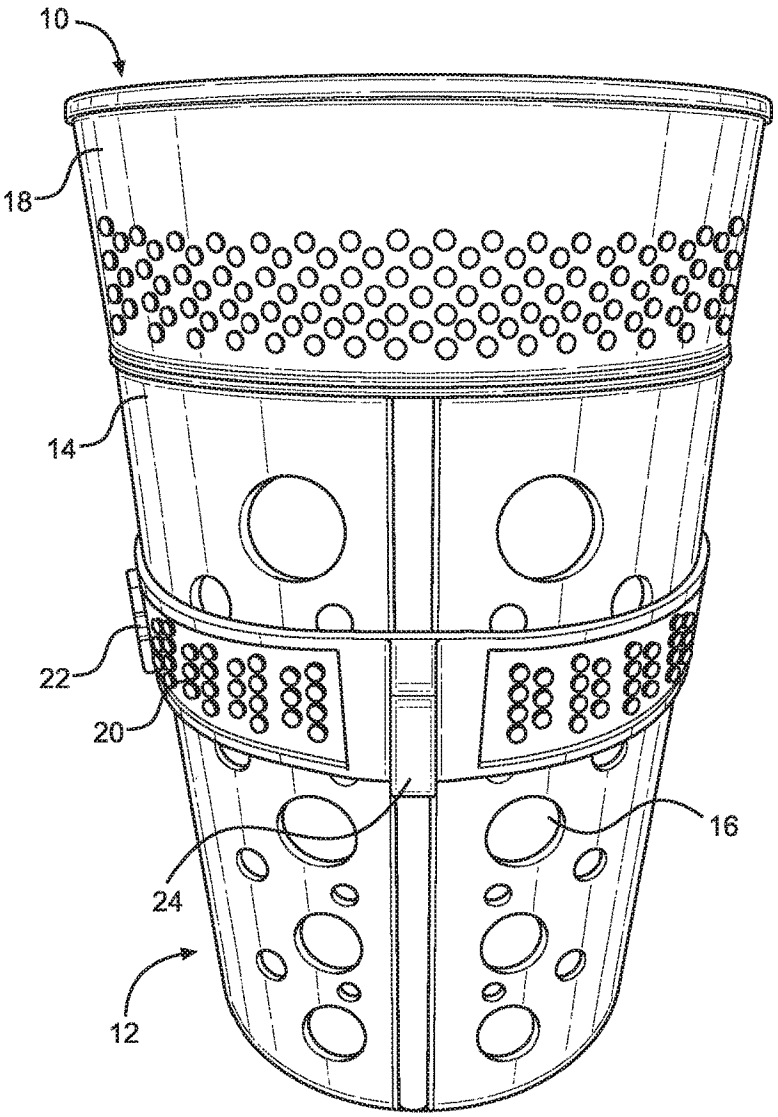
FIG. 4 is a view in side elevation of the collapsible vessel.
Figure 3:
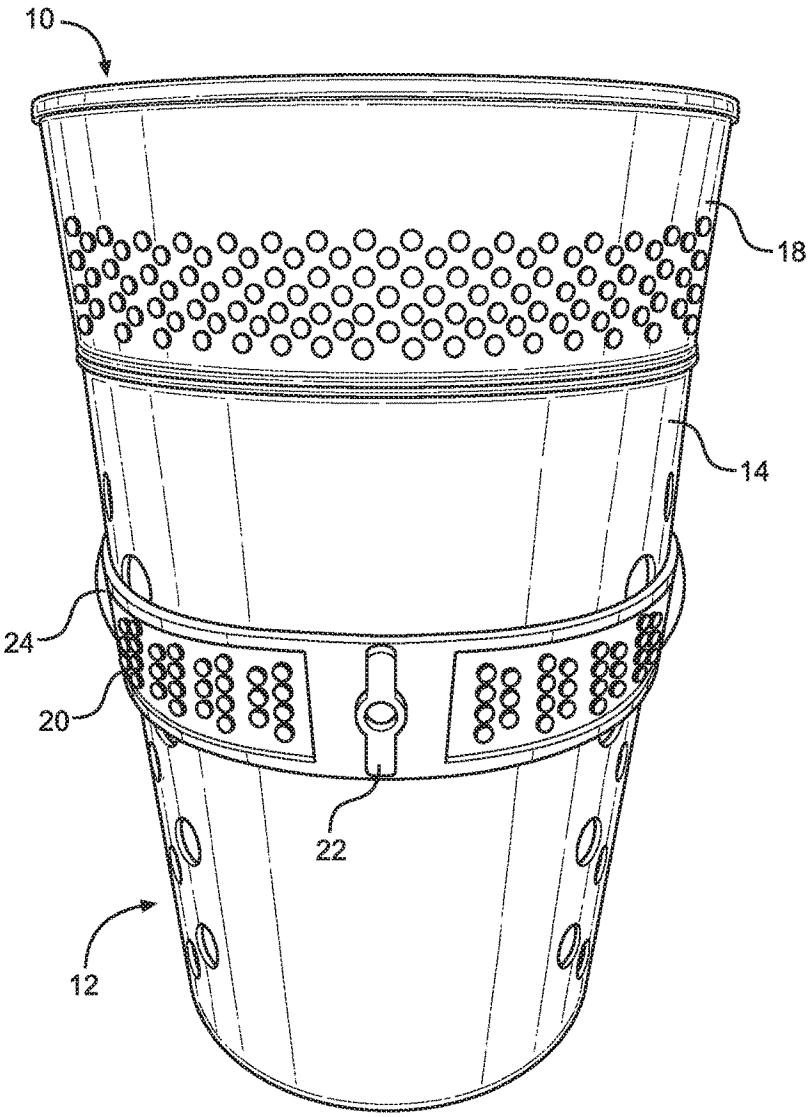
FIG. 3 is a view in front elevation of the collapsible vessel.
Figure 6:
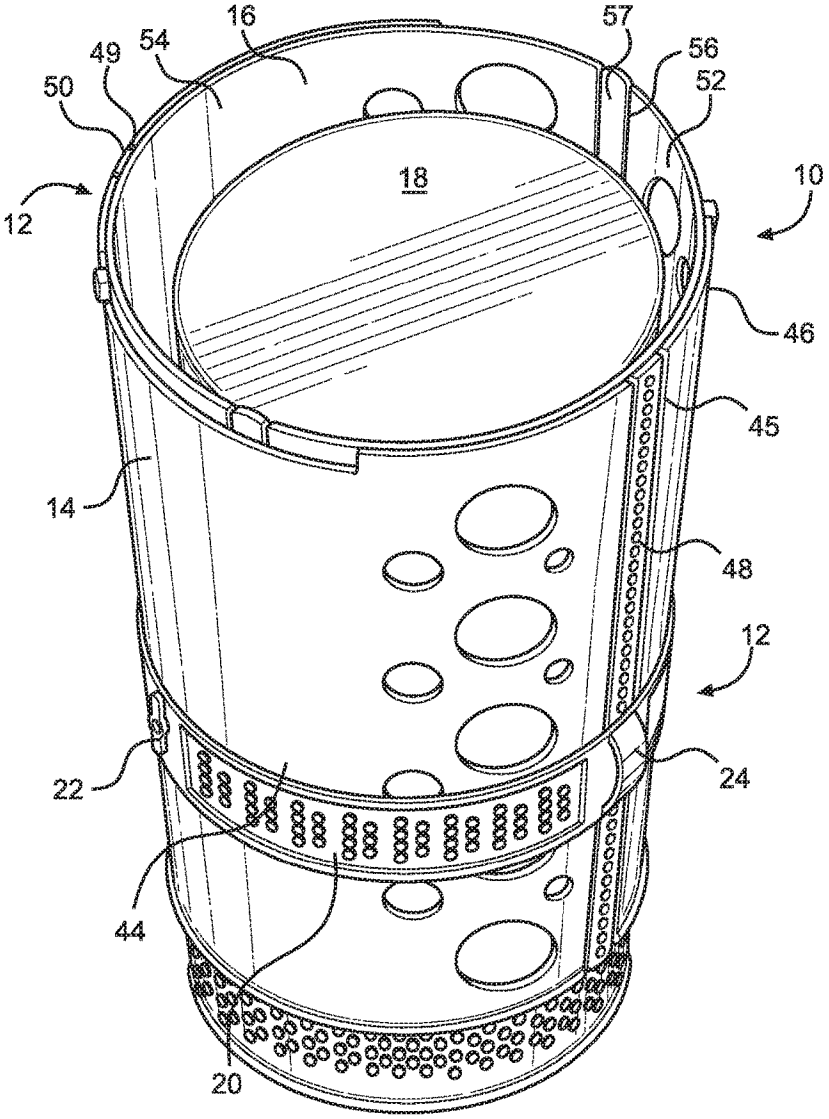
FIG. 6 is a further lower perspective view of the collapsible vessel.
Figure 15:
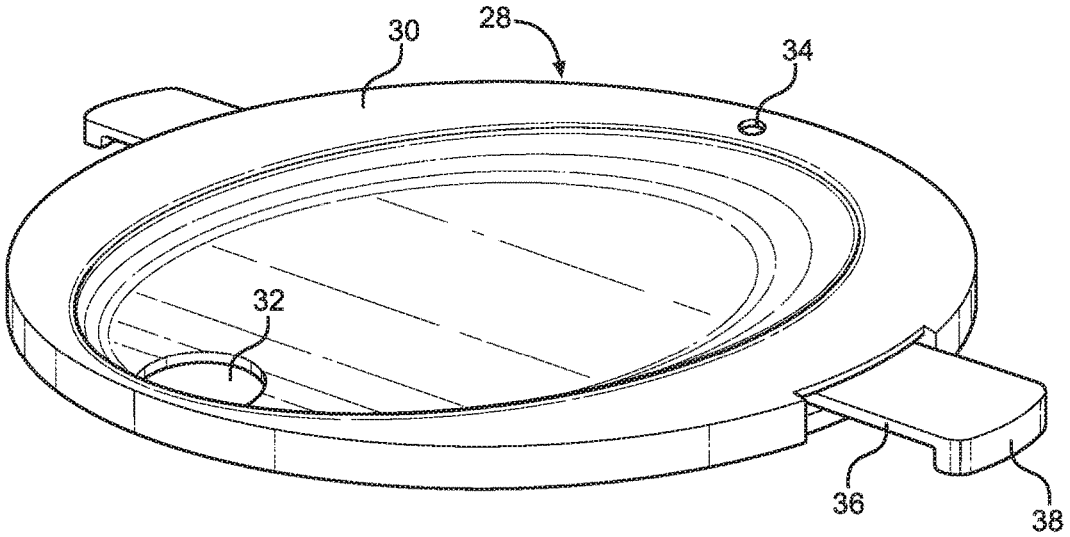
FIG. 15 is an upper perspective view of the lid structure for the collapsible vessel.
Figure 16:
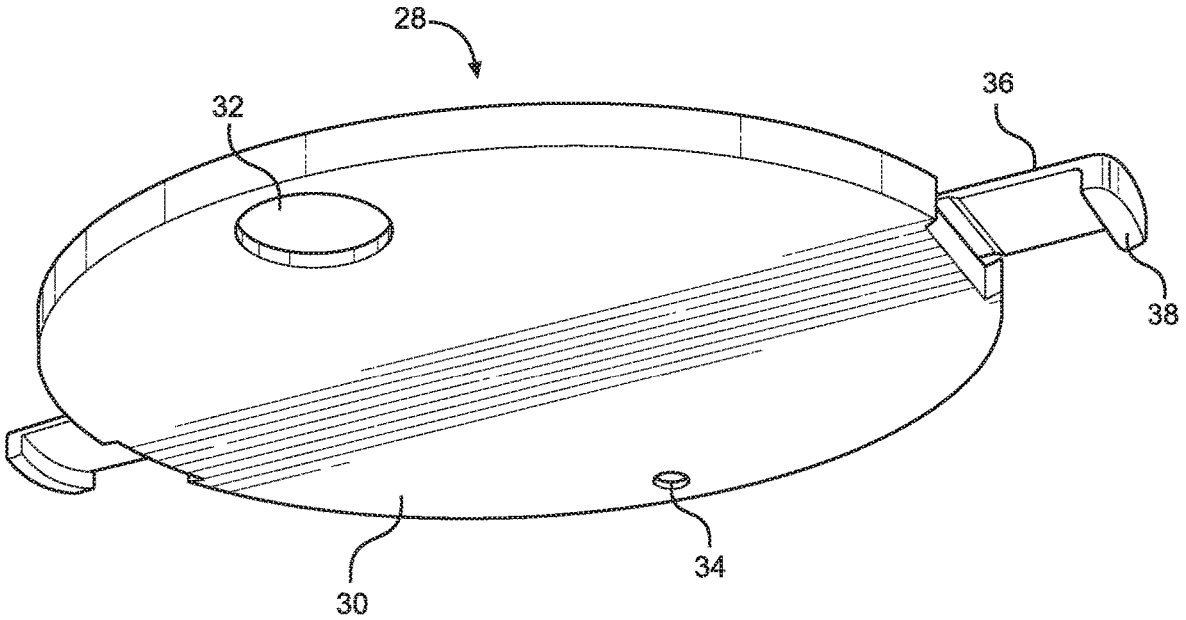
FIG. 16 is a lower perspective view of the lid structure for the collapsible vessel.
Figure 17:
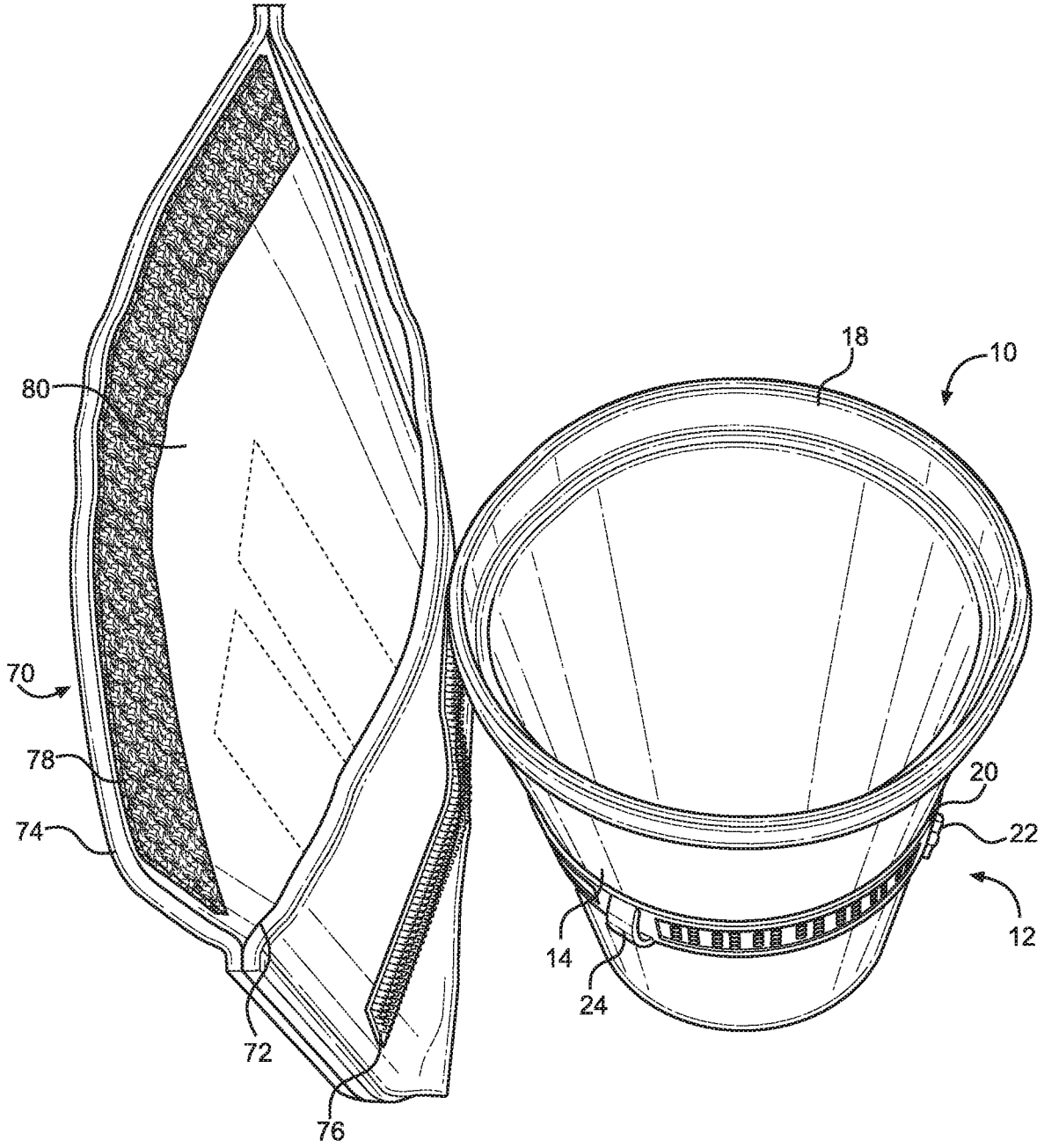
FIG. 17 is a perspective view of the collapsible vessel in an expanded, use configuration and with a vessel pouch.

Furthermore, again with combined reference to FIGS. 1 and 2 and with additional reference to FIGS. 15 and 16, the lid structure 28 includes first and second tabs 36 that are retained by the disk 30 to project from opposite sides thereof. The tabs 36 in this embodiment have proximal ends hingedly connected to the disk 30 and distal ends comprising protuberances, alternatively referred to as hook portions 38. The tabs 36 have lengths from the proximal ends thereof to proximal surfaces of the hook portions 38 approximately equal to a spacing of the upper surface of the retaining formation 26 to the fold line in the liner 18 that forms the upper edge of the liner 18 and the collapsible vessel 10 when the rim portion 62 of the liner 18 is folded over minus the local thickness of the disk 30.

In this embodiment, the disk 30 of the lid structure 28 has a flat lower surface and a contoured upper surface that facilitates sipping and draining of liquid into the inner volume of the vessel 10. A drinking aperture 32 through the disk 30 is provided coincident with a low portion of the contoured upper surface, and a venting aperture 34 through the disk 30 is provided substantially opposite to the drinking aperture 32. The drinking aperture 32 is sized to have an interference fit with a straw (not shown), such as a silicone straw that could likewise be partially or completely flattened. It is further contemplated that either or both apertures 32 and 34 could be selectively sealed, such as by one or more plugs (not shown) or other sealing mechanisms that would be obvious in view of the present disclosure.

Under this construction, the disk 30 can be inserted into the open liner 18, and the hook portions 38 of the tabs 36 will tend to cooperate with the retaining formation 26 in preventing over-insertion of the lid structure 28 and in ensuring proper orientation of the lid structure 28 in relation to the liner 18 and the sleeve combination 12. Additionally, the tabs 36 facilitate convenient removal of the lid structure 28. As shown in FIGS. 15 and 16, for example, the pivoting nature of the tabs 36 permits the lid structure 28 to pursue a substantially flat configuration for storage and transport. For instance, the lid structure 28 can be readily slipped into the flattened liner 18 when the collapsible vessel 10 is in the collapsed configuration.

As described hereinabove, when the fold line formations 45, 49, 53, and 57 of the inner and outer sleeves 16 and 14 are disposed out of alignment, such as by being spaced approximately ninety degrees apart, the collapsible vessel 10 is disposed in a use configuration wherein the sleeve combination 12 is substantially cylindrical and the liner 18 is retained in a tubular configuration with an open inner volume. A relative rotation of the inner and outer sleeves 16 and 14 to bring the fold line formations 45, 49, 53, and 57 into alignment permits the major walls 44 and 52 to be collapsed toward the opposed major walls 46 and 54 toward a flattened, collapsed configuration.

To promote a stable expanded configuration and an enhanced collapsed configuration, the collapsible vessel 10 further includes a retaining strap 20 of resilient material, such as a silicone rubber or other elastomeric material. The strap 20 in this embodiment has one or more portions thereof retained relative to the sleeve combination 12. More particularly, the strap 20 is rotatably secured to mid-portions of each of the major walls 44 and 46 of the outer sleeve 14. The strap 20 is rotatable about a pivot axis perpendicular to the sleeve combination 12 and the longitudinal axis thereof. The pivot axis in this embodiment is formed by first and second retaining members 22, each with a central post and distal wings for preventing inadvertent displacement of the strap 20. In addition to facilitating a pivoting of the strap 20, the retaining members 22 promote predetermined dispositions of the strap 20 as herein disclosed and prevent a loss of the strap 20.

The strap 20 can thus be disposed in a first orientation as in FIGS. 1 through 8, for example, where the resilient strap 20 encircles the sleeves 14 and 16 and the vessel 10 in general in a generally concentric manner. So disposed, the strap 20 provides a high-friction, projecting surface for permitting stable handling and retention of the vessel 10 and further thermal insulation between the vessel 10 and the hands of the user.

Figure 11:
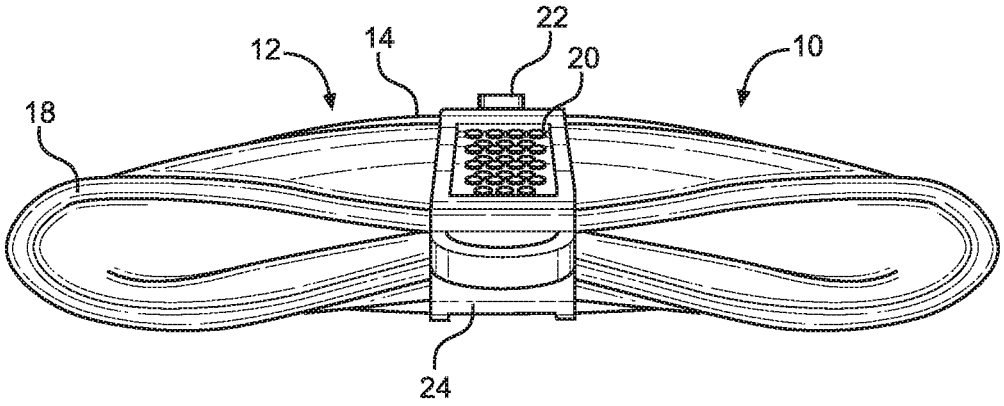
FIG. 11 is a top view of the collapsible vessel secured in a collapsed configuration.
Figure 12:
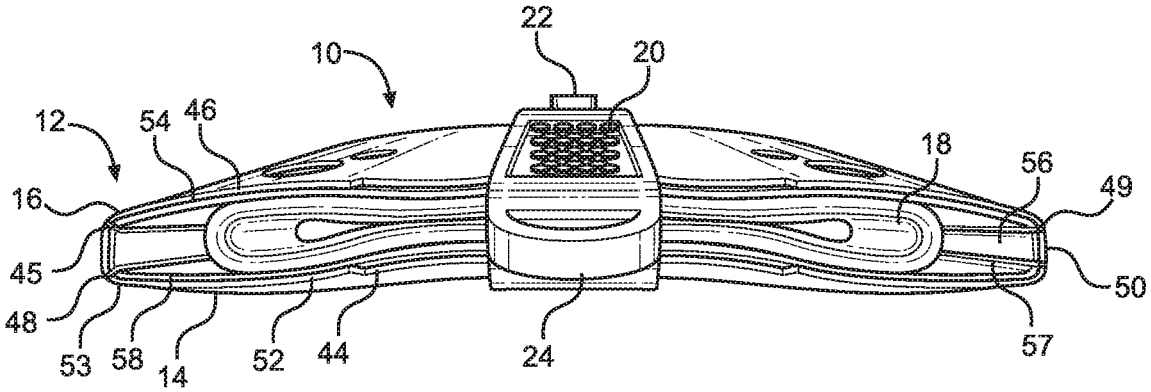
FIG. 12 is a bottom view of the collapsible vessel secured in a collapsed configuration.

Moreover, as shown in FIGS. 9 through 12 for example, when the vessel 10 is to be reconfigured to a collapsed configuration, the resilient strap 20 can be pivoted, such as by approximately ninety degrees, in relation to the sleeves 14 and 16 such that the strap 20 is generally aligned with the longitudinal axis of the vessel 10 and is generally centrally disposed between and in longitudinal alignment with the fold line formations 45, 49, 53, and 57. So disposed, the resilient strap 20 will span over the mouth of the liner 18 and the upper ends of the sleeves 14 and 16 approximately midway between the fold line formations 45, 49, 53, and 57, and the resilient strap 20 will span over the lower ends of the sleeves 14 and 16, again approximately midway between the fold line formations 45, 49, 53, and 57. As FIGS. 11 and 12 show perhaps most clearly, the resilient nature of the strap 20 will thus tend to cinch the upper and lower ends of the sleeves 14 and 16 to flattened configurations ideal for storage and transport. The strap 20 thus acts as a closure band when in the second orientation and as a gripping and stabilization band when in the first orientation.

The strap 20 has first and second thickened, raised gripping nubs 24 disposed midway along sections of the strap 20 between the pivot axis formed by the retaining members 22. The gripping nubs 24 thus generally align with the fold line formations 45 and 49 of the outer sleeve 14 when the strap 20 is in the first orientation, and the gripping nubs 24 tend to align generally with the openings at the upper and lower ends of the sleeve combination 12. The gripping nubs 24 facilitate an ergonomic gripping and manipulation of the strap 20, such as between the first and second orientations, and a stable gripping and fingertip control of the vessel 10 in general, including when the vessel 10 is laden with liquid or other material. Given their known orientation in relation to the vessel 10 and the components thereof, the nubs 24 additionally enable a tangible determination of the orientation of the vessel 10 and, potentially, the drinking aperture 32.

As referenced hereinabove, when the collapsible vessel 10 is in a collapsed configuration, it would be readily possible to retain the vessel 10 by a carabiner, a hook, or by some other mechanism, or the vessel 10 could be stowed at the discretion of the user. Within the scope of the invention, however, it is contemplated to provide a storage bag 70 that provides a number of benefits to the retention and storage of the vessel 10. Such a storage bag 70 and components thereof are depicted in FIGS. 17 through 23. There, the storage bag 70 can be seen to be founded on a main body 72 formed by first and second walls joined about three edges to be disposed in a facing relationship. The first and second walls define an inner volume bounded on three edges and with a mouth in which the collapsible vessel 10 can be inserted when in a collapsed configuration.

The storage bag 70 has a flap 74 that extends from first wall to be operative to close the mouth of the bag 70 when flapped over to overlie the second wall. In this embodiment, lateral fold lines are disposed in the first and second walls spaced from the upper ends thereof so that not only the flap 74 can be folded over but also the distal ends of the first and second walls to create a sealed environment within the bag 70. A fastening mechanism is provided for retaining the flap in the folded over, closed position of, for example, FIGS. 18 and 19. Here, the fastening mechanism comprises a combination of a section of hook material 76 on the body portion 72 and a section of loop material 78 on the flap 74, but other fastening mechanisms will be readily obvious after reviewing this disclosure and are within the scope of the invention.

In the depicted embodiment, the body 72 and the flap 74 are formed from a low friction material that can be formed or treated to be substantially waterproof. The main body 72 and the flap 74 can be formed of a flexible material. The material could be a fabric, such as a canvas or a polypropylene as non-limiting examples. Where the material of the first and second walls and the flap 74 is generally waterproof, the folded over distal portion of the bag 70 thus forms what can be referred to as a dry bag with a substantially sealed inner volume. The low friction material of the bag 70 will tend to be smoother than the polymeric liner 18 and retaining band 20 so that the vessel 10 disposed within the bag 70 can be more easily slipped into a storage location, such as a pocket or an article of luggage.

Figure 23:
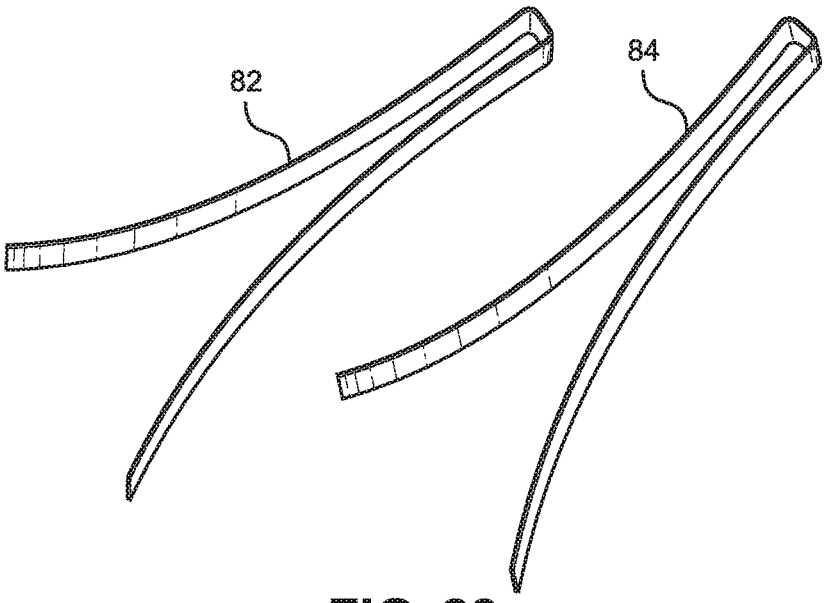
FIG. 23 is a perspective view of spring clips for the vessel pouch.

Furthermore, the storage bag 70 includes first and second stays, which are indicated at 82 and 84 in FIG. 23, that are retained on or within the first and second walls. In this embodiment, the stays 82 and 84 are of a substantially rigid yet resiliently deflectable material, such as a spring steel or a resiliently deflectable plastic as non-limiting examples. The stays 82 and 84 are generally V-shaped but with a flat proximal base end and first and second legs that are each spring-biased to an arcuate shape and a separated disposition. Here, the first and second stays 82 and 84 are sewn into pockets 80 or otherwise retained in relation to the body 72 of the bag 70 to have the legs of the stays 82 and 84 communicate longitudinally within the first and second walls of the body 72 and the flat proximal end span the proximal end of the bag formed by the proximal ends of the first and second walls. The stays 82 and 84 are retained in a generally parallel relationship within the walls of the body 72 such that, when the bag 70 is empty of the vessel 10, the bag 70 could be folded along a longitudinal midline between the stays 82 and 84 to achieve a more compact configuration. Moreover, with the retaining band 20 disposed in a longitudinally aligned orientation as in FIGS. 10 through 12, for example, the band 20 longitudinally aligns with the spacing between the stays 82 and 82 thereby to permit the bag 70 and the retained vessel 10 to achieve a most compact configuration.

Figure 18:
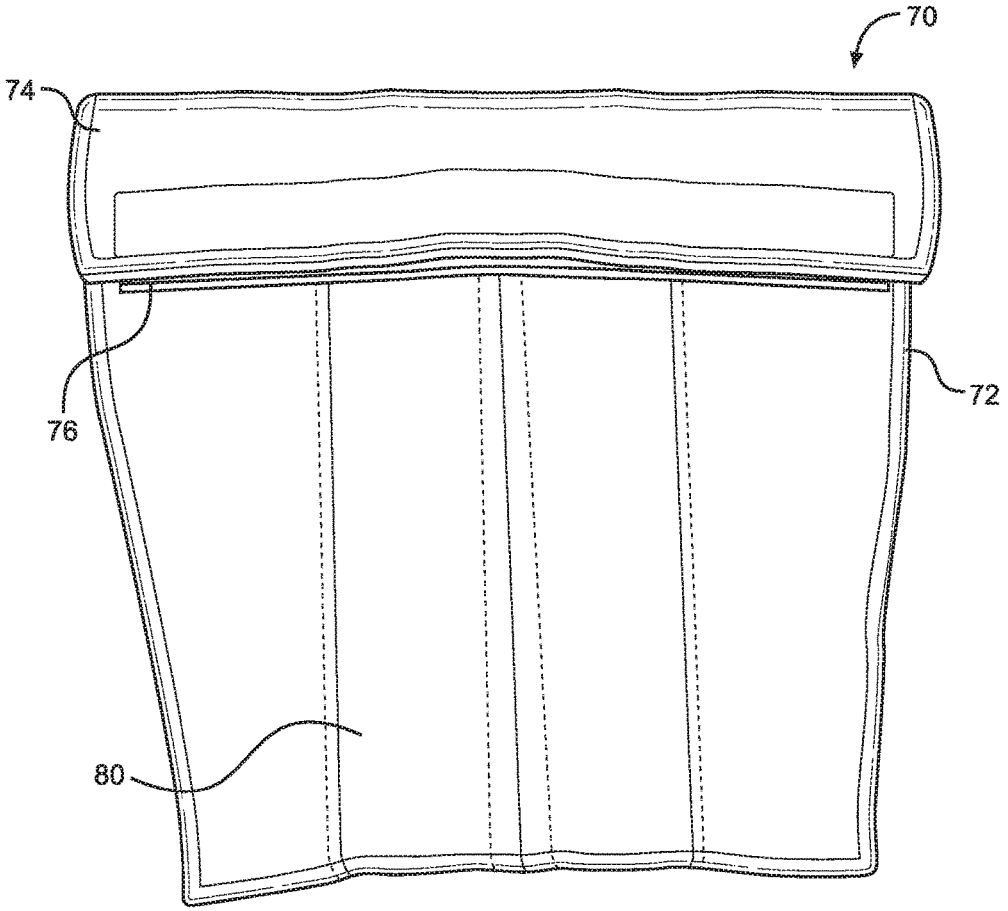
FIG. 18 is a view in front elevation of the vessel pouch in a closed configuration.
Figure 19:
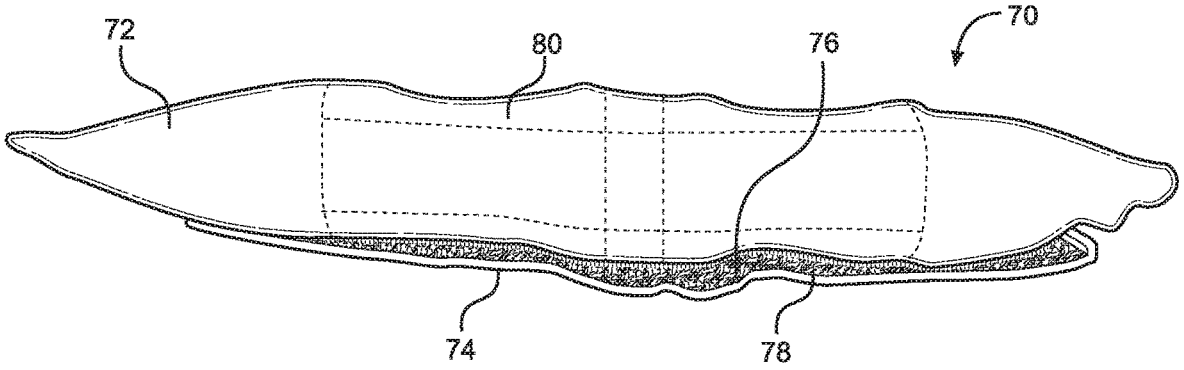
FIG. 19 is a bottom view of the vessel pouch.
Figure 20:
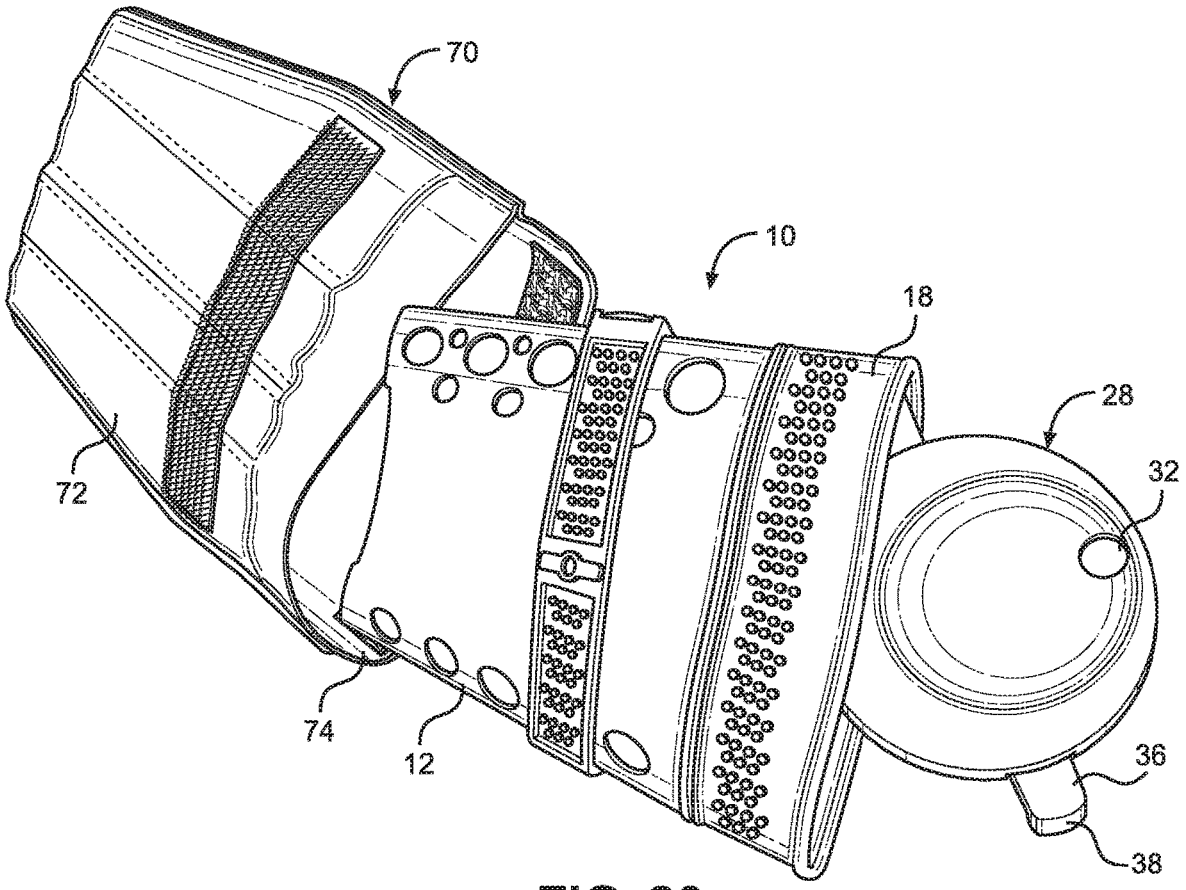
FIG. 20 is a perspective view of the collapsible vessel together with the vessel pouch and the vessel lid.
Figure 21:
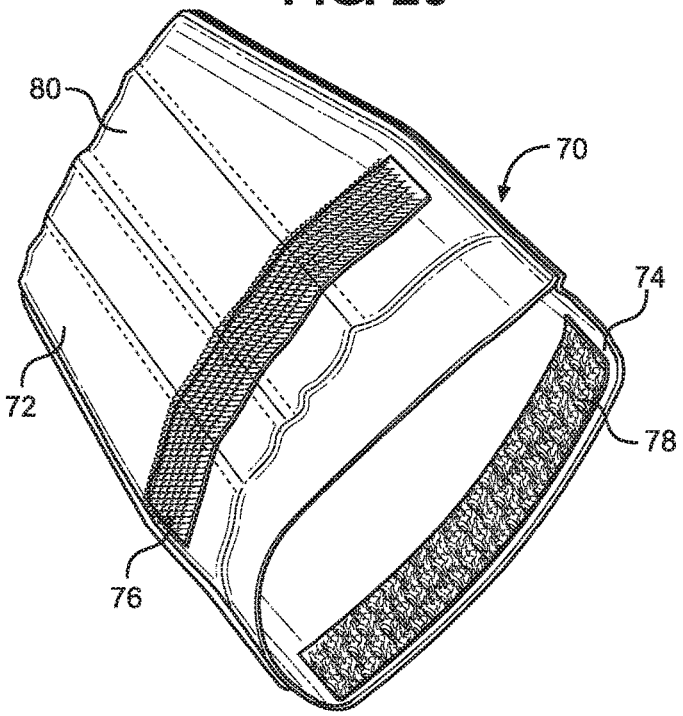
FIG. 21 is a perspective view of the vessel pouch in an open configuration.
Figure 22:
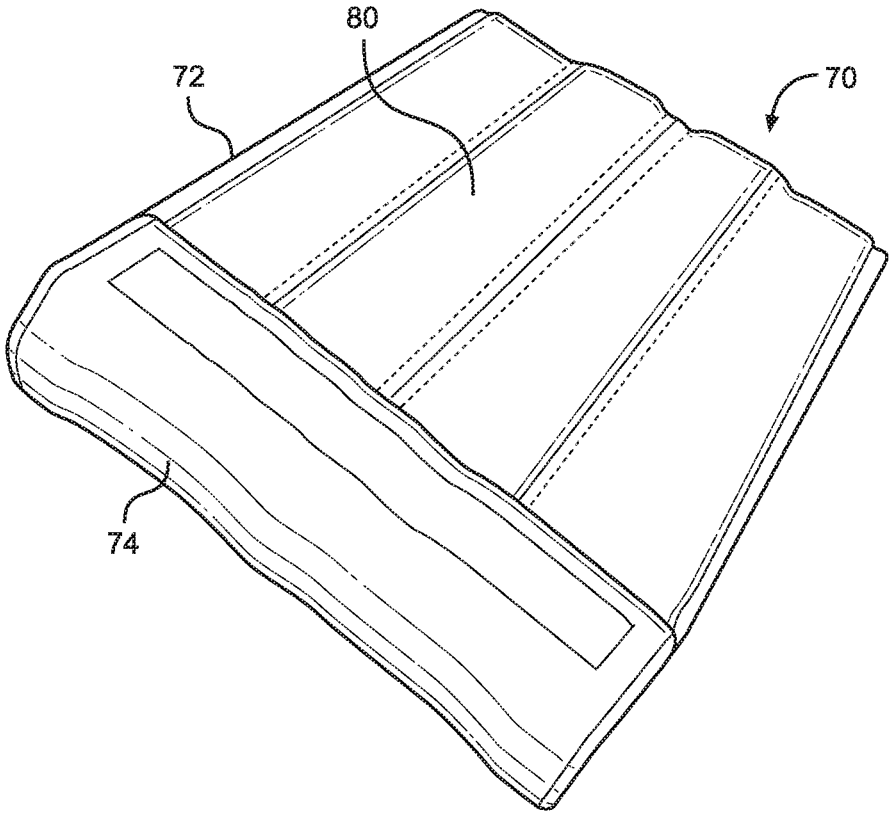
FIG. 22 is a perspective view of the vessel pouch in a closed configuration.

By virtue of the resilient, general V-shape of the stays 82 and 84, the bag 70 tends to be disposed with an open mouth and a tapering inner volume. Insertion of the collapsed vessel 10 into the inner volume of the bag 70 will tend to compress the vessel 10 further as the sleeve combination 12 is pressed into the V-shaped stays 82 and 84. Where the lower end of the vessel 10 is inserted first, the vessel 10 and the liner 18 thereof will tend to be progressively compressed from the lower end to the upper end thereof, which tends to force any residual moisture or other material from the liner 18. Furthermore, the legs of the stays 82 and 84 can be pressed together to drive the vessel 10 to a still further collapsed configuration and to expel residual material still more efficiently. The arcuate nature of the legs of the stays 82 and 84 tend to induce a progressive compression of the vessel 10 and the liner 18 to produce a most efficient expulsion of air and any residual moisture with the bottom of the vessel 10 being compressed first and the liner 18 gradually pressed together from the bottom of the liner 18 to the mouth of the liner 18. When the distal portion of the bag 70 and the flap 74 of the bag 70 are folded over as FIGS. 18, 19, and 22 show, for instance, the vessel 10 within the bag 70 is pressed by the stays 82 and 84 and the walls of the body portion 72 to a flattened configuration ideal for storage and transport. The collapsible vessel 10 so stored is protected against contamination and abrasion, and any further leakage from the vessel 10 to its surroundings is prevented.

With certain details and embodiments of the present invention for a collapsible vessel 10 disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments. Within the scope of the invention, the collapsible vessel 10 could include additional or fewer components, functions, or characteristics in comparison to the preferred, non-limiting embodiment disclosed herein. Although the foregoing components and arrangements of components may indeed be preferable and advantageous in achieving one or more objects of the invention, the collapsible vessel 10 shall not be interpreted to require all of the foregoing components, to be limited to the components of the preferred embodiment, or to be limited even to the positioning and configuration of individual components of the preferred embodiment except as the claims might expressly specify.

Therefore, the following claims shall define the scope of protection to be afforded to the inventors. Those claims shall be deemed to include equivalent constructions insofar as they do not depart from the spirit and scope of the invention. A plurality of the following claims may express, or be interpreted to express, certain elements as means for performing a specific function, at times without the recital of structure or material. As the law demands, any such claims shall be construed to cover not only the corresponding structure and material expressly described in this specification but also all legally cognizable equivalents thereof.

We claim as deserving the protection of Letters Patent:

1. A collapsible vessel reconfigurable between an expanded configuration for retaining a volume of material and a collapsed configuration, the collapsible vessel comprising:

a sleeve combination comprising an inner sleeve and an outer sleeve wherein the sleeve combination has a top, a bottom, and a longitudinal direction, wherein the inner sleeve has first and second opposed major walls divided by opposed fold line formations, wherein the outer sleeve has first and second opposed major walls divided by opposed fold line formations, wherein each fold line formation comprises at least one longitudinal fold line, and wherein each of the inner and outer sleeves is formed from a resiliently flexible material;

a liner for being retained by the sleeve combination wherein the liner is formed of flexible material; and arrays of flexion apertures in the first and second opposed major walls of each of the inner sleeve and the outer sleeve;

wherein the inner sleeve and the outer sleeve are relatively rotatable whereby the vessel can be retained in the expanded configuration with an open inner volume and a mouth defined by the liner when the opposed fold line formations of the inner sleeve are not aligned with the opposed fold line formations of the outer sleeve and wherein the vessel can be reconfigured to the collapsed configuration when the opposed fold line formations of the inner sleeve and the outer sleeve are aligned.

2. The collapsible vessel of claim 1 wherein the arrays of flexion apertures in the first and second opposed major walls of the inner sleeve and the outer sleeve substantially match in aperture shape and position.

3. The collapsible vessel of claim 2 wherein the arrays of flexion apertures in the first and second opposed major walls of the outer sleeve align with the arrays of flexion apertures in the first and second opposed major walls of the inner sleeve when the collapsible vessel is in the collapsed configuration and wherein the arrays of flexion apertures in the first and second opposed major walls of the outer sleeve do not align with the arrays of flexion apertures in the first and second opposed major walls of the inner sleeve when the collapsible vessel is in the expanded configuration.

4. The collapsible vessel of claim 1 wherein the arrays of flexion apertures in the first and second major walls of the inner and outer sleeves are symmetrically disposed in the respective major wall.

5. The collapsible vessel of claim 4 wherein the each of the arrays of flexion apertures in the first and second major walls of the inner and outer sleeves spans a lateral range from adjacent to the respective fold line formation toward a central portion of the major wall.

6. The collapsible vessel of claim 5 wherein the central portion of each major wall of the sleeve in which an array of flexion apertures is disposed is substantially solid and devoid of apertures.

7. The collapsible vessel of claim 1 further comprising a lid structure for selectively being engaged with the mouth defined by the liner when the collapsible vessel is in the expanded configuration wherein the lid structure comprises a disk and at least one retaining tab that projects from the disk wherein the retaining tab has a proximal end retained by the disk and a distal end with a protuberance.

8. The collapsible vessel of claim 1 further comprising a retaining strap retained by the sleeve combination wherein the retaining strap has a first orientation wherein the strap encircles the sleeve combination in a direction generally lateral to the longitudinal direction and a second orientation wherein the strap is disposed generally along the longitudinal direction to span over the top and the bottom of the sleeve combination.

9. The collapsible vessel of claim 8 wherein the strap is pivotally retained by the sleeve combination.

10. The collapsible vessel of claim 9 wherein the strap is pivotally retained by the sleeve combination at first and second pivoting locations with first and second strap sections between the pivoting locations.

11. The collapsible vessel of claim 10 further comprising a gripping nub disposed along each strap section.

12. The collapsible vessel of claim 1 wherein the inner sleeve has a lower end and an upper end, wherein the outer sleeve has a lower end and an upper end, and wherein the upper end of the inner sleeve extends beyond the upper end of the outer sleeve by a given distance such that an upper portion of the inner sleeve forms a rim portion of the sleeve combination.

13. The collapsible vessel of claim 12 wherein the liner has a body portion and a rim portion, wherein the body portion of the liner comprises a sidewall and a bottom that together form a liquid-tight container with a mouth and an inner volume when the collapsible vessel is in the expanded configuration, and wherein the rim portion of the liner can be folded over to a position overlapping the body portion of the liner to encircle the rim portion of the sleeve combination.

14. The collapsible vessel of claim 13 wherein the rim portion of the liner has a height approximately equal to the distance by which the inner sleeve extends beyond the outer sleeve of the sleeve combination.

15. The collapsible vessel of claim 1 wherein the at least one fold line of each fold line formation of the inner and outer sleeves comprises a living hinge.

16. The collapsible vessel of claim 15 wherein each fold line formation of the outer sleeve comprises a group of at least two fold lines whereby there are at least two fold lines to a first side of the outer sleeve and at least two fold lines to a second side of the outer sleeve opposite the first side whereby the outer sleeve has opposed minor walls.

17. The collapsible vessel of claim 16 wherein each fold line formation of the inner sleeve comprises a group of at least two fold lines whereby there are at least two fold lines to a first side of the inner sleeve and at least two fold lines to a second side of the inner sleeve opposite the first side whereby the inner sleeve has opposed minor walls.

18. The collapsible vessel of claim 1 wherein the liner is formed of rubber.

19. A collapsible vessel reconfigurable between an expanded configuration for retaining a volume of material and a collapsed configuration, the collapsible vessel comprising:

a sleeve combination comprising an inner sleeve and an outer sleeve wherein the sleeve combination has a top, a bottom, and a longitudinal direction, wherein the inner sleeve has first and second opposed major walls divided by opposed fold line formations, wherein the outer sleeve has first and second opposed major walls divided by opposed fold line formations, and wherein each fold line formation comprises at least one longitudinal fold line;

a liner for being retained by the sleeve combination wherein the liner is formed of flexible material; and arrays of flexion apertures in the first and second major walls of at least one of the inner sleeve and the outer sleeve, wherein the arrays of flexion apertures in the first and second major walls of the at least one of the inner and outer sleeves span a lateral range from adjacent to the respective fold line formation toward a central portion of the respective major wall, and wherein each array of flexion apertures has an aperture density that varies generally based on distance from the fold line formation of the respective sleeve adjacent to the array of flexion apertures;

wherein the inner sleeve and the outer sleeve are relatively rotatable whereby the vessel can be retained in the expanded configuration with an open inner volume and a mouth defined by the liner when the opposed fold line formations of the inner sleeve are not aligned with the opposed fold line formations of the outer sleeve and wherein the vessel can be reconfigured to the collapsed configuration when the opposed fold line formations of the inner sleeve and the outer sleeve are aligned.

20. The collapsible vessel of claim 19 wherein the aperture density increases from adjacent to the central portion of each major wall to adjacent to the fold line formation.

21. A collapsible vessel reconfigurable between an expanded configuration for retaining a volume of material and a collapsed configuration, the collapsible vessel comprising:

a sleeve combination comprising an inner sleeve and an outer sleeve wherein the sleeve combination has a top, a bottom, and a longitudinal direction, wherein the inner sleeve has first and second opposed major walls divided by opposed fold line formations, wherein the outer sleeve has first and second opposed major walls divided by opposed fold line formations, and wherein each fold line formation comprises at least one longitudinal fold line;

a liner for being retained by the sleeve combination wherein the liner is formed of flexible material;

arrays of flexion apertures in the first and second opposed major walls of at least one of the inner sleeve and the outer sleeve; and a lid structure for selectively being engaged with the mouth defined by the liner when the collapsible vessel is in the expanded configuration wherein the lid structure comprises a disk and at least one retaining tab that projects from the disk wherein the retaining tab has a proximal end retained by the disk and a distal end with a protuberance;

wherein the inner sleeve and the outer sleeve are relatively rotatable whereby the vessel can be retained in the expanded configuration with an open inner volume and a mouth defined by the liner when the opposed fold line formations of the inner sleeve are not aligned with the opposed fold line formations of the outer sleeve and wherein the vessel can be reconfigured to the collapsed configuration when the opposed fold line formations of the inner sleeve and the outer sleeve are aligned; and wherein the liner defines a rim with an upper edge when the collapsible vessel is in the expanded configuration, wherein the at least one retaining tab has a length from the proximal end of the at least one retaining tab to a proximal surface of the protuberance of the distal end of the at least one retaining tab, and wherein the disk has a thickness in proximity to the at least one retaining tab and further comprising an annular retaining formation disposed on the liner for engaging the disk of the lid structure wherein the retaining formation is spaced from the upper edge of the rim defined by the liner by approximately the length of the retaining tab from the proximal end of the at least one retaining tab to a proximal surface of the protuberance of the distal end of the at least one retaining tab.

22. A collapsible vessel that is reconfigurable between an expanded configuration with an open inner volume for retaining a volume of material and a collapsed configuration, the collapsible vessel comprising:

a sleeve structure comprising a first sleeve, wherein the sleeve structure has a top, a bottom, and a longitudinal direction, wherein the first sleeve has first and second opposed major walls divided by opposed fold line formations, and wherein each fold line formation comprises at least one longitudinal fold line;

a liner for being retained by the sleeve structure wherein the liner is formed of flexible material; and a retaining strap retained relative to the sleeve structure wherein the retaining strap has a first orientation wherein the strap encircles the sleeve structure in a direction generally lateral to the longitudinal direction and a second orientation wherein the strap is disposed generally along the longitudinal direction to span over the top and the bottom of the sleeve structure, wherein the strap is pivotally retained by the sleeve structure, and wherein the strap is pivotally retained by the sleeve structure at first and second pivoting locations with first and second strap sections between the pivoting locations;

wherein the vessel can be retained in the expanded configuration with an open inner volume and a mouth defined by the liner and wherein the vessel can be reconfigured to the collapsed configuration.

23. The collapsible vessel of claim 22 further comprising a gripping nub disposed along each strap section.

24. The collapsible vessel of claim 22 wherein the sleeve structure further comprises a second sleeve, wherein the first sleeve comprises an inner sleeve, wherein the second sleeve comprises an outer sleeve, and wherein the outer sleeve has first and second opposed major walls divided by opposed fold line formations wherein each fold line formation comprises at least one longitudinal fold line.

25. The collapsible vessel of claim 24 further comprising arrays of flexion apertures in the opposed major walls of at least one of the inner sleeve and the outer sleeve.

26. The collapsible vessel of claim 25 wherein the array of flexion apertures in each major wall is symmetrically disposed in the major wall to span a lateral range from adjacent to the respective fold line formation toward a central portion of the major wall.

* * * * *